US009589552B1

(12) United States Patent
Nishi

(10) Patent No.: US 9,589,552 B1
(45) Date of Patent: Mar. 7, 2017

(54) PERCUSSION INSTRUMENT AND CAJON

(71) Applicant: Roland Corporation, Shizuoka (JP)

(72) Inventor: Hiroyuki Nishi, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 15/086,059

(22) Filed: Mar. 31, 2016

(30) Foreign Application Priority Data

Dec. 2, 2015 (JP) ..... 2015-235994

(51) Int. Cl.
*G10H 3/12* (2006.01)
*G10H 3/14* (2006.01)
*G10D 13/02* (2006.01)

(52) U.S. Cl.
CPC ..... *G10H 3/146* (2013.01); *G10D 13/02* (2013.01); *G10H 3/12* (2013.01)

(58) Field of Classification Search
CPC ..... G10H 3/12
USPC ..... 84/723
See application file for complete search history.

(56) References Cited

U.S. PATENT DOCUMENTS 2,900,453 A * 8/1959 Cammack ..... H04R 9/08 181/158
3,553,339 A * 1/1971 Dominguez ..... G10H 3/146 84/725
5,801,320 A 9/1998 Segan et al.
6,121,538 A 9/2000 Yoshino et al.
6,982,376 B2 1/2006 Wise
7,196,261 B2 3/2007 Suenaga
7,282,633 B1 * 10/2007 Coolidge ..... G10H 3/143 84/104
7,482,522 B2 * 1/2009 Wening ..... G10D 13/025 84/411 R
7,485,790 B2 * 2/2009 Payerl ..... G10D 13/02 84/411 R (Continued)

FOREIGN PATENT DOCUMENTS

JP 2008-191202 8/2008
JP 5668437 2/2015

(Continued)

OTHER PUBLICATIONS

Gomm, Jon; https://www.youtube.com/watch?v=QIUKaEhgcV0. Viewed online on Aug. 20, 2016.*

(Continued)

*Primary Examiner* — David Warren
(74) *Attorney, Agent, or Firm* — Jianq Chyun IP Office

(57) ABSTRACT

Provided is a percussion instrument capable of enhancing the expressiveness of performance. A struck surface plate that vibrates to produce a musical sound when struck is disposed on a case, and a sound emission hole is formed to penetrate the struck surface plate. A musical signal is generated by a sound source device according to detection results of percussion sensors that detect the vibration caused by the striking on the struck surface plate. A sounding body produces an electronic musical sound based on the musical signal generated by the sound source device. Because the sounding body is disposed in the case, the musical sound produced by the vibration of the case and the electronic musical sound can be produced from the one case. Accordingly, the expressiveness of the performance using the percussion instrument can be enhanced.

20 Claims, 10 Drawing Sheets

(56) References Cited

U.S. PATENT DOCUMENTS

| | | | | |
|---|---|---|---|---|
| 7,816,596 | B2 * | 10/2010 | Boettger | G10D 13/02 84/411 R |
| 8,350,138 | B2 * | 1/2013 | Schmader | G10D 13/02 84/411 R |
| 8,481,834 | B2 * | 7/2013 | Eduardo | G10D 13/02 84/411 R |
| 8,735,704 | B2 * | 5/2014 | Buchner | G10D 13/02 84/411 R |
| 9,087,497 | B1 * | 7/2015 | Krol | G10D 13/02 |
| 2005/0022655 | A1 | 2/2005 | Wise | |
| 2008/0110321 | A1 * | 5/2008 | Wening | G10D 13/025 84/421 |
| 2009/0158914 | A1 * | 6/2009 | Boettger | G10D 13/02 84/421 |
| 2009/0188373 | A1 | 7/2009 | May | |
| 2012/0073420 | A1 * | 3/2012 | Schmader | G10D 13/021 84/415 |
| 2012/0132058 | A1 * | 5/2012 | Dublin | G10D 13/02 84/723 |
| 2013/0180382 | A1 * | 7/2013 | Buchner | G10D 13/02 84/411 R |
| 2014/0013930 | A1 * | 1/2014 | Dahl | G10H 3/143 84/730 |
| 2014/0208925 | A1 * | 7/2014 | Osborne | G10D 13/02 84/725 |
| 2014/0224099 | A1 * | 8/2014 | Webman | G10H 3/18 84/630 |
| 2015/0114206 | A1 * | 4/2015 | Krol | G10D 13/025 84/417 |
| 2015/0356960 | A1 * | 12/2015 | Webman | G10H 3/18 84/630 |
| 2015/0379977 | A1 | 12/2015 | Steele | |

FOREIGN PATENT DOCUMENTS

| | | |
|---|---|---|
| JP | 2015-079272 | 4/2015 |
| JP | 2015-092261 | 5/2015 |

OTHER PUBLICATIONS

Magik. The first electronic cajon—duende, http://www.duendepercusion.com/producto/magik-the-first-electronic-cajon/, retrieved on Mar. 11, 2016, "Magik. The First Electronic Cajon".

Electronic Cajon Released by Flink Labs—PlayCajon, http://playcajon.org/2014/03/19/electronic-cajon/, retrieved on Mar. 11, 2016, "Electronic Cajon Released by Flink Labs".

Build an E-Cajon—Power Hell, https://powerhell.wordpress.com/about/zourman/poor-mans-td-20/build-a-e-cajoni, retrieved on Mar. 11, 2016, "Build an E-Cajon".

"Search Report of Europe Counterpart Application", issued on Jul. 11, 2016, p. 1-p. 7, in which the listed references were cited.

* cited by examiner

PERCUSSION INSTRUMENT AND CAJON

CROSS-REFERENCE TO RELATED APPLICATION

This application claims the priority benefit of Japan Application No. 2015-235994, filed on Dec. 2, 2015. The entirety of the above-mentioned patent application is hereby incorporated by reference herein and made a part of this specification.

BACKGROUND OF THE INVENTION

Field of the Invention

The invention relates to a percussion instrument and a cajon and relates to a percussion instrument and a cajon that are capable of enhancing the expressiveness of performance.

Description of Related Art

A device has been known, in which a pickup for detecting vibration is disposed in a percussion instrument that vibrates to produce a musical sound when struck and an output signal of the pickup is processed to be outputted to an external device, such as a speaker. For example, there is a device in which pickups are respectively disposed on multiple surfaces of a cajon, i.e. a percussion instrument, and musical signals corresponding to the struck positions of the multiple pickups are outputted from a sound processing device to an external device.

SUMMARY OF THE INVENTION

Problem to be Solved

However, in an environment where it is not possible to connect an external device, the percussion instrument (cajon) alone is poor in performance expressiveness.

The invention has been made in view of the above and provides a percussion instrument and a cajon that are capable of enhancing the expressiveness of performance.

Solution to the Problem and Effect of the Invention

In view of the above, according to a percussion instrument of an embodiment, a struck surface part that vibrates to produce a musical sound when struck is disposed on at least a surface of a case, and a sound emission hole is rimmed to penetrate a predetermined surface of the case. A musical signal is generated by a sound source device according to a detection result of a percussion sensor that detects vibration caused by the striking on the struck surface part, and a sounding body produces an electronic musical sound based on the musical signal generated by the sound source device. Because the sounding body is disposed in the case, the musical sound produced by the vibration of the case and the electronic musical sound can be produced from the one case. Accordingly, an effect of enhancing the expressiveness of the performance using the percussion instrument is achieved.

According to the percussion instrument of an embodiment, the percussion sensor includes a first sensor that detects the vibration of the struck surface part and a second sensor that detects the vibration of a part different from the struck surface part of the case. Because the first sensor and the second sensor can detect vibrations of different positions, the struck position can be determined based on an output result of the first sensor and an output result of the second sensor. Because the musical signal of a tone corresponding to the struck position can be generated by the sound source device, an effect of changing the tone of the electronic musical sound according to the struck position can be achieved.

The second sensor includes a supported part supported by the part different from the struck surface part of the case, and a swing part extending from the supported part to swing with respect to the supported part. At least a part of a detecting element that detects vibration is disposed on the swing part. Because the swing part amplifies the vibration for the detecting element to detect the vibration in a swing direction of the swing part, in addition to the effect of the aforementioned embodiment, an effect of improving the detection sensitivity of the second sensor is achieved.

According to the percussion instrument of an embodiment, the electronic musical sound is produced from the sounding body at a timing that is 3-6 msec later than a timing when the struck surface part is struck to produce the musical sound. Therefore, in 3-6 msec later than the timing that the musical sound is produced by the vibration of the case, the electronic musical sound is produced. Accordingly, in addition to the effect of the aforementioned embodiment, an effect of highlighting the electronic musical sound over the musical sound produced by the vibration of the case while synthesizing the musical sound produced by the vibration of the case and the electronic musical sound into a series of musical sounds is achieved.

According to the percussion instrument of an embodiment, the sounding body is disposed inside the case at a predetermined distance from the sound emission hole. Accordingly, in addition to the effect of the aforementioned embodiment, an effect of releasing the wind pressure generated inside the case by the striking on the struck surface part through the sound emission hole and emitting the electronic musical sound to the outside of the case through the sound emission hole is achieved.

According to the percussion instrument of an embodiment, because a center of the sounding body is located on an inner side of the sound emission hole when viewed from a sound axis direction of the sounding body, the middle to high-pitched electronic musical sound produced from the center side of the sounding body can be directly emitted to the outside of the case through the sound emission hole. Accordingly, in addition to the effect of the aforementioned embodiment, an effect of suppressing reduction of the middle to high-pitched electronic musical sound, which results from blocking of the case, is achieved.

According to the percussion instrument of an embodiment, a resonance hole is formed on a surface, which is different from the surface where the sound emission hole is formed. Accordingly, in addition to the effect of the aforementioned embodiment, an effect of enhancing a predetermined frequency band of the musical sound emitted from the inside to the outside of the case by the resonance hole is achieved.

According to the percussion instrument of an embodiment, at least a part of the sounding body is disposed inside the case and the resonance hole is disposed at a position opposite to the struck surface part. A cylindrical port connected to the resonance hole extends from the resonance hole into case in a direction that intersects the vibration direction of the struck surface part. Thus, the wind pressure generated inside the case due to the striking on the struck surface part can be dispersed by the port. Accordingly, in addition to the effect of the aforementioned embodiment, an effect of reducing the influence, which the wind pressure generated by the striking on the struck surface part imposes on the sounding body, is achieved.

According to a cajon of an embodiment, a case vibrates to produce a musical sound when a struck surface plate disposed on the case is struck. A sound source device generates a musical signal according to a detection result of a percussion sensor that detects the striking on the struck surface plate and a player's operation of an operation member, and a sounding body produces an electronic musical sound based on the musical signal generated by the sound source device. The case includes an upper surface plate, a lower surface plate opposite to the upper surface plate, and a side surface plate connecting the upper surface plate and the lower surface plate. A part of the side surface plate is the struck surface plate. Because the operation member is disposed on the upper surface plate sat by the player, the player can easily operate the operation member while sitting on the case during performance. Since the electronic musical sound can be changed easily during the performance, an effect of enhancing the expressiveness of the performance using the cajon is achieved.

According to a cajon of an embodiment, a case vibrates to produce a musical sound when a struck surface plate disposed on a front surface of the case is struck. A sound source device generates a musical signal according to a detection result of a percussion sensor that detects the striking on the struck surface plate, and a sounding body produces an electronic musical sound based on the musical signal generated by the sound source device. The case includes an upper surface plate, a lower surface plate opposite to the upper surface plate, and a side surface plate connecting the upper surface plate and the lower surface plate. A part of the side surface plate is the struck surface plate. The percussion sensor includes a first sensor that detects the vibration of the struck surface plate and a second sensor that detects the vibration of the upper surface plate. Because the first sensor and the second sensor can detect vibrations of different positions, the struck position can be determined based on an output result of the first sensor and an output result of the second sensor. Because the musical signal of a tone corresponding to the struck position can be generated by the sound source device, an effect of changing the tone of the electronic musical sound according to the struck position to enhance the expressiveness of the performance using the cajon is achieved.

Because the second sensor is attached to the upper surface plate on the side of the struck surface plate, when the struck surface plate is struck on the side of the upper surface plate, the distance from the struck position to the second sensor is shortened. As the distance from the struck position to the second sensor is shortened, more shock (vibration) is transmitted to the second sensor. Therefore, the second sensor can easily detect the striking on the struck surface plate on the side of the upper surface plate.

According to the cajon of an embodiment, the first sensor is supported through a support that extends vertically at a predetermined distance from the upper surface plate where the second sensor is attached. Thus, transmission of vibration between the parts that respectively support the first sensor and the second sensor can be suppressed. As a result, in addition to the effect of the aforementioned embodiment, an effect of suppressing erroneous detection of the first sensor and the second sensor to ensure detection accuracy is achieved.

According to the cajon of an embodiment, the first sensor is located on a left side with respect to a lateral center of the struck surface plate and in a vertical center of the struck surface plate in the front view. A right-handed player usually strikes the vertical center on the left side of the struck surface plate with right hand at the first beat (downbeat) during performance. Therefore, the distance from the struck position to the first sensor is shortened. Because the shock (vibration) transmitted from the struck position to the first sensor can be increased, in addition to the effect of the aforementioned embodiment, the first sensor can accurately detect the right-handed player's striking of the first beat.

According to the cajon of an embodiment, because the center of the sounding body is located on the right side with respect to the lateral center of the struck surface plate in the front view and is located on the side of the lower surface plate with respect to the first sensor, the sounding body and the first sensor and the second sensor can be separated by a distance. As a result, in addition to the effect of the aforementioned embodiment, an effect of suppressing the percussion sensor from erroneously detecting the vibration of the sounding body is achieved.

According to the cajon of an embodiment, the sound emission hole is formed to penetrate the left side or the right side of the struck surface plate with respect to a centerline that bisects the struck surface plate into left and right parts in the front view. Because the struck surface plate has the sound emission hole, the directions of the musical sound produced by the vibration of the struck surface plate and the musical sound emitted from the sound emission hole can be uniformized.

If the centerline that bisects the struck surface plate into left and right parts is divided by the sound emission hole, the sound quality of the musical sound produced by the vibration of the struck surface plate will be significantly different from the sound quality of the musical sound produced by a struck surface plate that has no sound emission hole. Because the sound emission hole penetrates the left side or the right side of the struck surface plate with respect to the centerline that bisects the struck surface plate into left and right parts, the sound quality of the musical sound produced by the vibration of the struck surface plate can be close to the sound quality of the musical sound produced by a struck surface plate that has no sound emission hole. Accordingly, in addition to the effect of the aforementioned embodiment, the invention achieves an effect that the directions of the musical sound produced by the vibration of the struck surface plate and the musical sound emitted from the sound emission hole can be uniformized, and the sound quality of the musical sound produced by the vibration of the struck surface plate can be close to the sound quality of the musical sound produced by a struck surface plate that has no sound emission hole.

DESCRIPTION OF THE EMBODIMENTS

Figure 1:
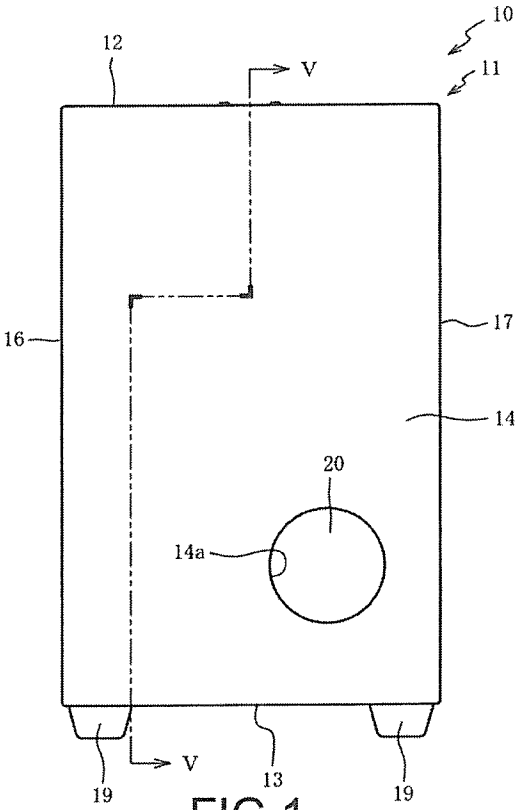
FIG. 1 is a front view of the percussion instrument according to the first embodiment of the invention.
Figure 2:
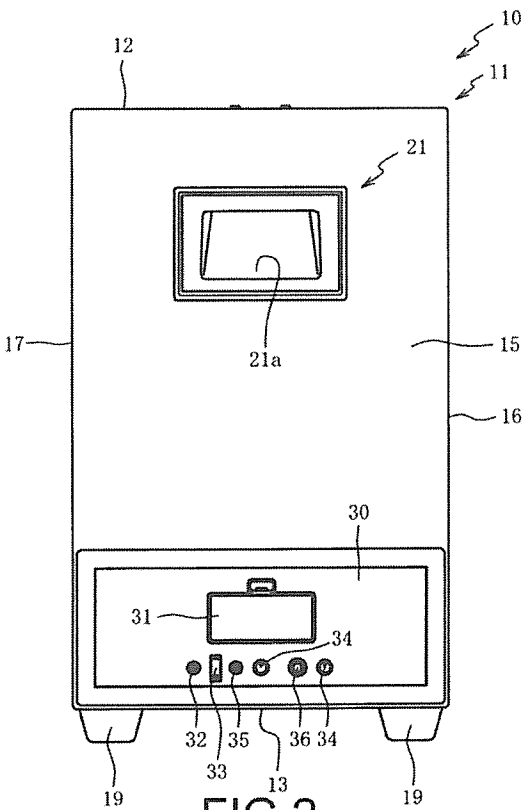
FIG. 2 is a rear view of the percussion instrument.
Figure 3:
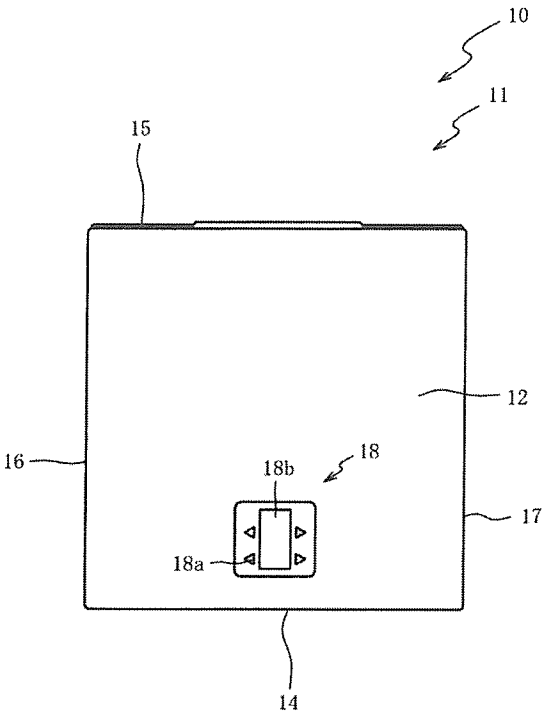
FIG. 3 is a top view of the percussion instrument.

Below exemplary embodiments of the invention are described with reference to the affixed figures. First, a schematic configuration of a percussion instrument 10 according to the first embodiment of the invention is described with reference to FIG. 1 to FIG. 3. FIG. 1 is a front view of the percussion instrument 10 according to the first embodiment of the invention, FIG. 2 is a rear view of the percussion instrument 10, and FIG. 3 is a top view of the percussion instrument 10. The upper side, lower side, near side, far side, left side, and right side of FIG. 1 are respectively set as the top, bottom, front, rear, left, and right of the percussion instrument 10.

As shown in FIG. 1 to FIG. 3, the percussion instrument 10 is a cajon and includes a rectangular parallelepiped-shaped case 11 that is formed hollow by an upper surface plate 12, a lower surface plate 13, and a side surface plate. The upper surface plate 12 constitutes an upper surface to be sat by a player. The lower surface plate 13 constitutes a lower surface opposite to the upper surface plate 12. The side surface plate connects the upper surface plate 12 and the lower surface plate 13 to constitute a side surface. The side surface plate is composed of a struck surface plate (struck surface part) 14 located in front (the near side of the paper surface of FIG. 1), a rear surface plate 15 opposite to the struck surface plate 14, a left surface plate 16 located on the left side in the front view, and a right surface plate 17 opposite to the left surface plate 16.

Like a general cajon, the percussion instrument 10 (the case 11) is formed to be about 300 mm in depth (front-rear direction), about 300 mm in width, and about 500 mm in height. When the player strikes the struck surface plate 14 while sitting on the upper surface plate 12, the entire case 11, particularly the struck surface plate 14, vibrates such that the percussion instrument 10 produces an acoustic musical sound. The percussion instrument 10 mainly produces two types of musical sounds according to the struck positions. Specifically, the percussion instrument 10 produces a relatively low-pitched musical sound when the center of the struck surface plate 14 is struck and produces a relatively high-pitched musical sound when the upper end side (the side of the upper surface plate 12) of the struck surface plate 14 is struck.

The upper surface plate 12 is a wooden flat plate and is provided with an operation panel 18 that is located in a lateral center on the side of the struck surface plate 14. The operation panel 18 includes an operation member 18*a* to be operated by the player and a display device 18*b* for displaying an operation state of the operation member 18*a*. The lower surface plate 13 is a square flat plate and rubber feet 19 are attached to four corners of the lower surface plate 13.

The struck surface plate 14 (a part of the side surface plate) is a wooden flat plate and is formed thinner than the upper surface plate 12, the lower surface plate 13, the rear surface plate 15, the left surface plate 16, and the right surface plate 17. Accordingly, the rigidity of the struck surface plate 14 is reduced to make it easy to vibrate the struck surface plate 14. A part of the struck surface plate 14 from the upper end (the end part on the side of the upper surface plate 12) to a vertical center is the portion that is primarily struck by the player.

A circular sound emission hole 14*a* is formed to penetrate the struck surface plate 14 on the right side (the side of the right surface plate 17) with respect to the lateral center and on the lower side (the side of the lower surface plate 13) with respect to the vertical center. The sound emission hole 14*a* is an opening for releasing a wind pressure that is generated inside the case 11 by the striking on the struck surface plate 14 to the outside of the case 11. Considering the appearance, the sound emission hole 14*a* is covered by a meshed sheet 20 to make it difficult to see the inside of the case 11. A diameter of the sound emission hole 14*a* is preferably set to 60 mm (the opening area is about 28 $cm^2$) or more. In this embodiment, the diameter of the sound emission hole 14*a* is set to 90 mm (the opening area is about 64 $cm^2$).

The rear surface plate 15 (a part of the side surface plate) is a wooden flat plate. A handle 21 is attached to the rear surface plate 15 on the upper side (the side of the upper surface plate 12) with respect to the vertical center and a rear surface panel 30 is provided on the lower side (the side of the lower surface plate 13) with respect to the vertical center in the rear view. The left surface plate 16 (a part of the side surface plate) and the right surface plate 17 (a part of the side surface plate) are wooden flat plates.

The rear surface panel 30 is a part where knobs for operating a sound source device 50 (to be described later) or terminals for connecting the sound source device 50 and an external device are disposed. The rear surface panel 30 includes a battery box 31 for accommodating a battery (not shown) that serves as a power source of the sound source device 50, an external power source terminal 32 for connecting an external power source (not shown) that serves as the power source of the sound source device 50 in place of the battery, a power source switch 33 for turning on/off the power source of the sound source device 50, a rear surface operation member 34 to be operated by the player, and an input terminal 35 and an output terminal 36 for electrically connecting the external device (not shown) and the sound source device 50.

Figure 4:
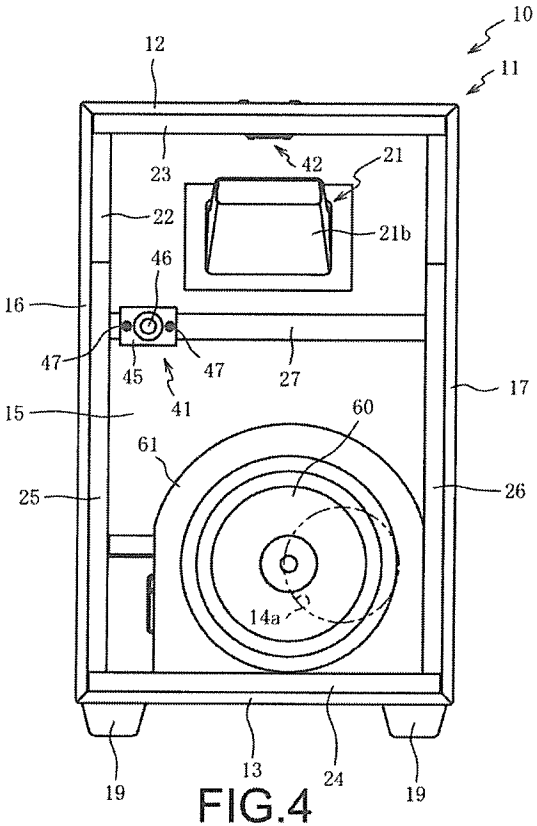
FIG. 4 is a front view of the percussion instrument with the struck surface plate removed.
Figure 5:
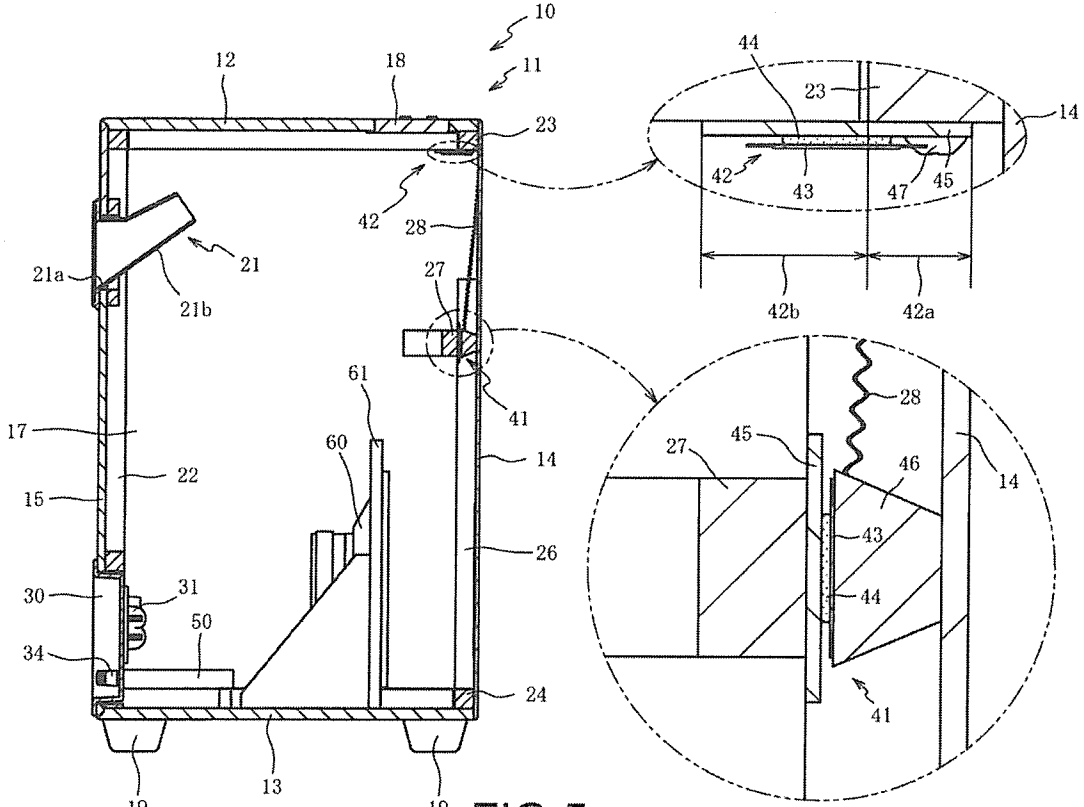
FIG. 5 is a cross-sectional view of the percussion instrument along the line V-V of FIG. 1.

Next, an internal structure of the percussion instrument 10 is described with reference to FIG. 4 and FIG. 5. FIG. 4 is a front view of the percussion instrument 10 with the struck surface plate 14 removed and FIG. 5 is a cross-sectional view of the percussion instrument 10 along the line V-V of FIG. 1. In FIG. 4 and FIG. 5, wiring for connecting the operation panel 18 or a first sensor 41, a second sensor 42, the sound source device 50, a sounding body 60, and so on is omitted.

As shown in FIG. 4 and FIG. 5, the case 11 includes a plurality of reinforcing members 22 composed of bar-shaped square materials for connecting edges of the upper surface plate 12, the lower surface plate 13, the rear surface plate 15, the left surface plate 16, and the right surface plate 17. The upper surface plate 12, the lower surface plate 13, the rear surface plate 15, the left surface plate 16, the right surface plate 17, and the reinforcing members 22 are bonded to each other by an adhesive, so as to prevent sound leakage from connection portions of the plates 12, 13, 15, 16, and 17.

A square bar-shaped first horizontal member 23 (a part of the upper surface plate 12) is disposed on the upper surface plate 12 along the edge on the side of the struck surface plate 14, and a square bar-shaped second horizontal member 24 is disposed on the lower surface plate 13 along the edge on the side of the struck surface plate 14. A square bar-shaped first support 25 (post) is disposed on the left surface plate 16 along the edge on the side of the struck surface plate 14, and a square bar-shaped second support 26 (post) is disposed on the right surface plate 17 along the edge on the side of the struck surface plate 14. The first support 25 and the second support 26 extend in a vertical direction from the second horizontal member 24 to keep a predetermined interval with respect to the first horizontal member 23 (the upper surface plate 12). A support part 27 is laid across the first support 25 and the second support 26.

The case 11 is formed by fastening the edges of the struck surface plate 14 to the first horizontal member 23 of the upper surface plate 12, the second horizontal member 24 of the lower surface plate 13, the first support 25 of the left surface plate 16, and the second support 26 of the right surface plate 17 with wood screws (not shown). Therefore, the struck surface plate 14 can be replaced easily by removing the wood screws. In addition, by adjusting the tightness of the wood screws that fasten the struck surface plate 14, the way the struck surface plate 14 vibrates can be adjusted and the tone of the musical sound generated by the vibration of the struck surface plate 14 can be changed.

The support part 27 is a bar-shaped square material disposed at a predetermined distance from the struck surface plate 14, and a base end of a snare wire type echo wire 28 is attached such that a front end of the echo wire 28 is in contact with the struck surface plate 14. A musical sound is produced by the contact between the struck surface plate 14 that vibrates when struck and the echo wire 28. Nevertheless, the echo wire 28 is not limited to the snare wire type. It is also possible to use a string type echo wire. In the case of using a string type echo wire, two ends of the echo wire are respectively attached to the upper surface plate 12 (the first horizontal member 23) and the lower surface plate 13 (the second horizontal member 24) to make the echo wire in contact with the struck surface plate 14.

The handle 21 is a part where a front end of a portion for inserting a hand is opened, and a cylindrical port 21*b* is connected to a resonance hole 21*a* that penetrates the rear surface plate 15 in a plate thickness direction. The port 21*b* extends into the case 11 from the resonance hole 21*a* to form the handle 21. The port 21*b* is a part that has a substantially rectangular cross section. The port 21*b* extends from the resonance hole 21*a* toward the upper surface plate 12 with a decreasing cross-sectional area. Accordingly, the player can put the hand into the handle 21 and hold the handle 21 easily and the opening area of the front end of the port 21*b* can be reduced. In this embodiment, the opening area of the front end of the port 21*b* (a minimum cross-sectional area of the resonance hole 21*a* and the port 21*b*) is set to about 20 $cm^2$. Like the sound emission hole 14*a*, the wind pressure generated inside the case 11 by the striking on the struck surface plate 14 can be released to the outside of the case 11 through the resonance hole 21*a* and the port 21*b*.

The percussion instrument 10 includes a mechanism for producing an electronic musical sound when the struck surface plate 14 is struck. Specifically, the percussion instrument 10 includes the first sensor 41 and the second sensor 42 (percussion sensors) for detecting the striking on the struck surface plate 14, the sound source device 50 for generating a musical signal according to detection results of the first sensor 41 and the second sensor 42, and the sounding body 60 for producing an electronic musical sound based on the musical signal generated by the sound source device 50.

The first sensor 41 and the second sensor 42 respectively include a disk-shaped piezoelectric element 43 which is a vibration detecting element, a disk-shaped double-sided tape 44 which has a cushioning property and is bonded to one surface of the piezoelectric element (detecting element) 43, and a rectangular substrate 45 to which the piezoelectric element 43 is attached through the double-sided tape 44. The piezoelectric element 43 primarily detects deformation in the plate thickness direction. By making a diameter of the double-sided tape 44 smaller than a diameter of the piezoelectric element 43, the piezoelectric element 43 can be deformed easily. Accordingly, the detection sensitivity of the first sensor 41 and the second sensor 42 can be ensured.

The first sensor 41 is a sensor for detecting the vibration of the struck surface plate 14. A truncated cone-shaped cushioning material 46 composed of a sponge is bonded to a surface of the piezoelectric element 43 that is opposite to the surface where the double-sided tape 44 is bonded, and the cushioning material 46 is in contact with the struck surface plate 14. The piezoelectric element 43 of the first sensor 41 primarily detects vibration in the front-rear direction (vibration direction of the struck surface plate 14). The cushioning material 46 is a member for preventing interference with the vibration of the struck surface plate 14 caused by contact of the first sensor 41. The cushioning material 46 is not bonded to the struck surface plate 14 and is compressed between the piezoelectric element 43 and the struck surface plate 14.

The first sensor 41 is located on the left side (the side of the left surface plate 16) with respect to the lateral center of the struck surface plate 14 and located in the vertical center of the struck surface plate 14 in the front view. The first sensor 41 is disposed between the struck surface plate 14 and the support part 27, and the substrate 45 is fastened to the support part 27 by the wood screws 47. Because the first sensor 41 detects the vibration of the struck surface plate 41 through the cushioning material 46 by the piezoelectric element 43 and the piezoelectric element 43 is located between the struck surface plate 14 and the support part 27, displacement of the first sensor 41 caused by the vibration of the struck surface plate 14 can be restricted by the support part 27.

The second sensor 42 is a sensor for detecting vibration of the upper surface plate 12 (a part different from the struck surface plate 14 of the case 11). The second sensor 42 is attached to the first horizontal member 23 of the upper surface plate 12 and maintained not in contact with the struck surface plate 14 for the piezoelectric element 43 of the second sensor 42 to detect vibration in the vertical direction (a direction perpendicular to the vibration direction of the struck surface plate 14). The second sensor 42 is located in the lateral center of the struck surface plate 14 in the front view.

The second sensor 42 includes a supported part 42*a* supported by the first horizontal member 23 and a swing part 42*b* that extends from the supported part 42*a* to swing in the vertical direction with respect to the supported part 42*a*. Regarding the supported part 42*a*, the substrate 45 is fastened to the first horizontal member 23 by the wood screws 47. A part of the piezoelectric element 43 is disposed on the swing part 42*b*. Because the swing part 42*b* amplifies the vibration for the piezoelectric element 43 to detect the vibration of the swing part 42*b* in the vibration direction, the detection sensitivity of the second sensor 42 can be improved.

The sound source device 50 is disposed on an inner side of the lower surface plate 13 and on the rear surface panel 30. The sounding body 60 is a cone type speaker that has a circular shape in the front view and has an output of about 3W, and power is supplied from the sound source device 50. Accordingly, because the sounding body 60 can be made lighter and power consumption of the sounding body 60 can be suppressed, the percussion instrument 10 can be carried around easily, and when the sound source device 50 is battery-driven, the duration of the battery can be ensured. It is also possible to use a speaker having an output other than 3W as the sounding body 60.

The sounding body 60 is disposed inside the case 11. The sounding body 60 is supported by a sounding body support part 61 attached to the lower surface plate 13. A front surface of the sounding body 60 faces the struck surface plate 14, such that a sound axis thereof is perpendicular to the struck surface plate 14. The sounding body 60 is disposed such that, when viewed from a sound axis direction (in the front view), the center of the sounding body 60 is on the right side (the side of the right surface plate 17) with respect to the center of the struck surface plate 14 and on the lower side (the side of the lower surface plate 13) with respect to the first sensor 41.

The sounding body 60 is disposed such that, when viewed from the sound axis direction (in the front view), the center of the sounding body 60 is located on the inner side of the sound emission hole 14*a*. The sounding body 60 is disposed between the struck surface plate 14 and the sound source device 50 and is separated from the struck surface plate 14 (the sound emission hole 14*a*) by a predetermined distance (about 70 mm in this embodiment). Accordingly, the wind pressure generated by the striking on the struck surface plate 14 can be released to the outside of the case 11 through the sound emission hole 14*a*.

The sounding body support part 61 is a plate-shaped member that separates the front and the rear of the sounding body 60, and is attached upright on the lower surface plate 13. A distance from the sounding body support part 61 (the rear of the sounding body 60) to the rear surface plate 15 is set longer than a distance from the sounding body support part 61 (the front of the sounding body 60) to the struck surface plate 14 (the sound emission hole 14*a*).

The sounding body support part 61 extends from an outer edge of the sounding body 60 in a radial direction of the sounding body 60. Because the produced electronic musical sound has reverse phases on the front and the rear of the sounding body 60, the low-pitched electronic musical sound that is easily diffracted may be canceled on the front and the rear of the sounding body 60. By separating the front and the rear of the sounding body 60 with the sounding body support part 61, offset of the low-pitched electronic musical sound can be suppressed.

Figure 6:
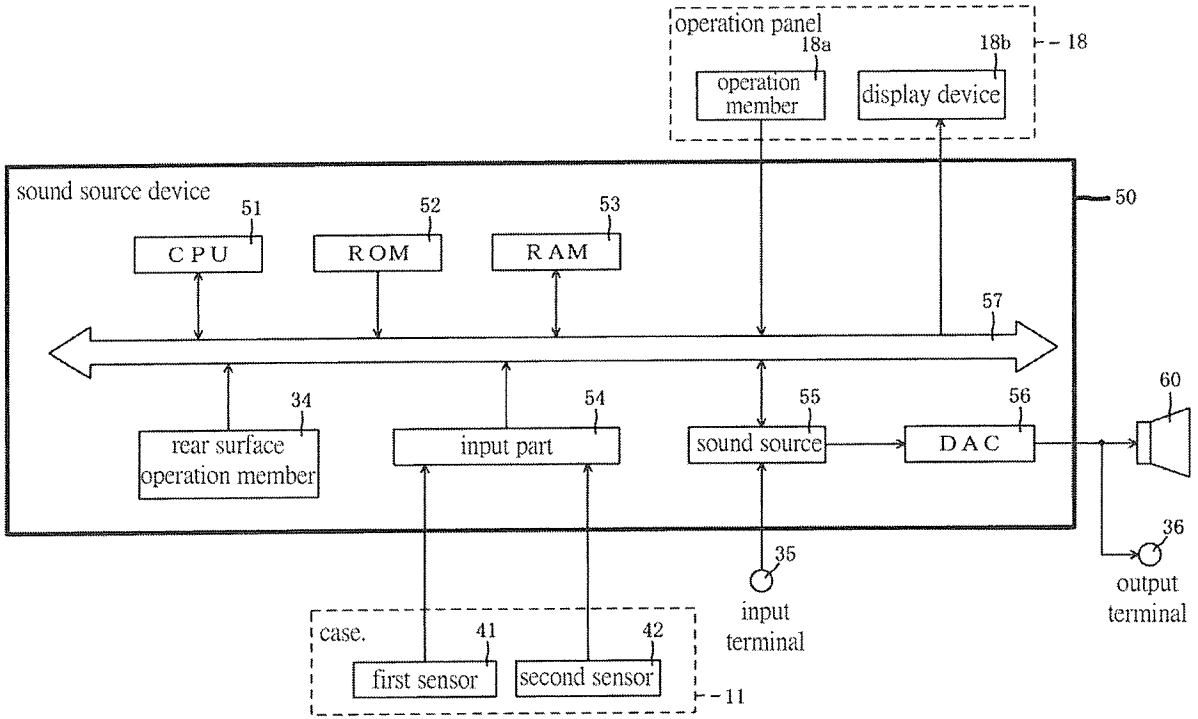
FIG. 6 is a block diagram showing an electrical configuration of the sound source device.

Next, an electrical configuration of the sound source device 50 is described with reference to FIG. 6. FIG. 6 is a block diagram showing the electrical configuration of the sound source device 50. The sound source device 50 includes a CPU (central processing unit) 51, a ROM (read-only memory) 52, a RAM (random access memory) 53, an input part 54, a sound source 55, a digital-to-analog converter (DAC) 56, and the rear surface operation member 34, wherein the parts 34 and 51-56 are connected by a bus line 57. The operation member 18*a* and the display device 18*b* are connected to the parts 34 and 51-56 of the sound source device 50 via the bus line 57. The first sensor 41 and the second sensor 42 installed in the case 11 are connected to the input part 54.

The CPU 51 is a central control unit that controls each part of the sound source device 50 according to fixed values or programs stored in the ROM 52 and data stored in the RAM 53. The ROM 52 is a rewritable non-volatile memory and stores control programs (not shown) to be executed by the CPU 51 or the sound source 55 or fixed value data (not shown) to be referred to by the CPU 51 or the sound source 55 when the control programs are executed.

The RAM 53 is a rewritable volatile memory and has a temporary area for temporarily storing various data as the CPU 51 executes the control programs. The rear surface operation member 34 is a knob for setting parameters of volume or parameters of balance between the detection sensitivity of the first sensor 41 and the detection sensitivity of the second sensor 42.

The input part 54 is an interface for connecting the first sensor 41 and the second sensor 42 installed in the case 11. Analog signal waveforms outputted from the first sensor 41 and the second sensor 42 are inputted to the sound source device 50 via the input part 54. The input part 54 includes a built-in analog-to-digital converter (not shown). The analog signal waveforms outputted from the first sensor 41 and the second sensor 42 are converted to digital values by the analog-to-digital converter every predetermined time. Based on the digital values converted in the input part 54, the CPU 51 determines whether the case 11 (the struck surface plate 14) is struck, the struck position, the striking strength, and so on and gives the sound source 55 a sound production instruction according to the determination.

When receiving the musical sound production instruction from the CPU 51, the sound source 55 generates musical signals of tone and volume corresponding to the sound production instruction or operation states of the operation member 18*a* and the rear surface operation member 34. The sound source 55 includes a built-in waveform ROM (not shown). The waveform ROM stores the musical signal of a tone corresponding to the struck position of the case 11 or the operation state of the operation member 18*a*.

Nevertheless, it is also possible not to build the waveform ROM in the sound source 55 and to store the musical signal of a tone corresponding to the struck position of the case 11 or the operation state of the operation member 18*a* in the ROM 52 instead. In addition, the invention is not limited to the case where the sound source 55 generates the musical signals of tone and volume corresponding to the sound production signal from the CPU 51 and the operation states of the operation member 18*a* and the rear surface operation member 34. It is also possible that the CPU 51 gives the sound source 55 the sound production instruction corresponding to the operation states of the operation member 18*a* and the rear surface operation member 34 and performs control such that the sound source 55 generates the musical signals of tone and volume corresponding to the sound production instruction.

Moreover, the sound source 55 includes a built-in DSP (digital signal processor), which is not shown, for processing of filters or effects. If the sound production instruction is inputted from the CPU 51, the sound source 55 reads the musical signal of tone in accordance with the sound production instruction from the waveform ROM and performs predetermined processing such as filters or effects in the DSP and then outputs the processed musical signal to the DAC 56. The DAC 56 converts the inputted musical signal from digital to analog and outputs it to the sounding body 60 disposed outside the sound source device 50. With the sound source device 50, the sounding body 60 generates an electronic musical sound corresponding to the detection results of the first sensor 41 and the second sensor 42 based on the striking on the case 11.

It is possible to connect an amplifier between the DAC 56 and the sounding body 60. In addition, an external device such as an audio player (not shown) may be connected to the input terminal 35 for the sound source device 50 to produce music stored in the audio player through the sounding body 60. An external device such as an amplifier or a speaker (not shown) may be connected to the output terminal 36 for the sound source device 50 to produce an electronic musical sound based on the musical signal generated by the sound source 55 through the external device.

Figure 7:
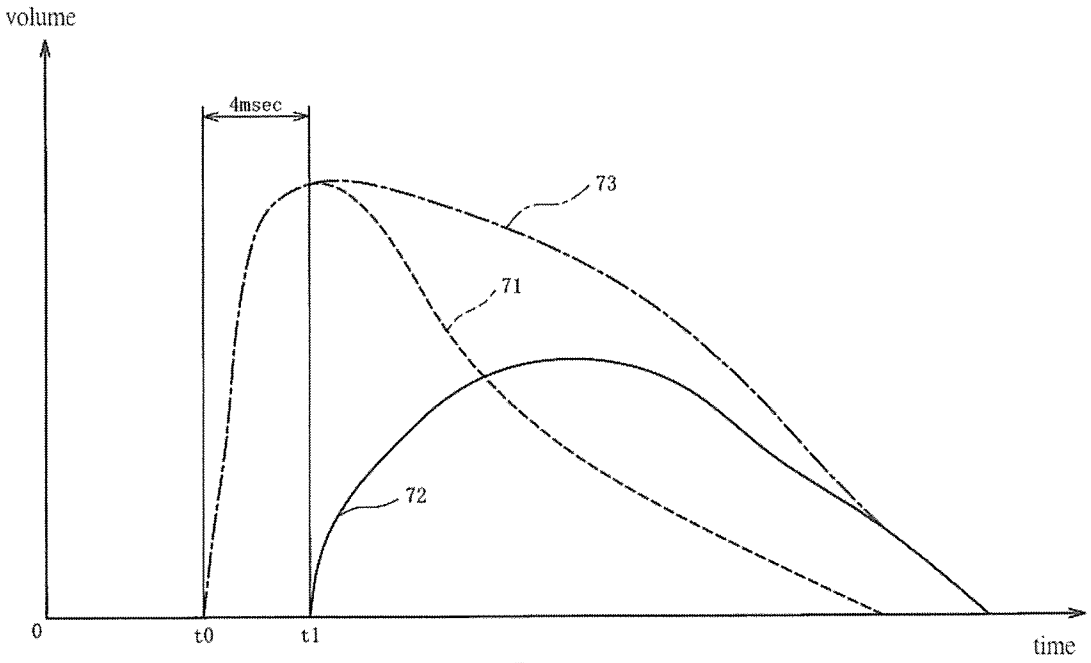
FIG. 7 is a volume-time graph of a musical sound, an electronic musical sound, and a synthetic musical sound when the struck surface plate is struck.

Next, the control performed by the sound source device 50 is described with reference to FIG. 7. FIG. 7 is a volume-time graph of an acoustic musical sound 71, an electronic musical sound 72, and a synthetic musical sound 73 when the struck surface plate 14 is struck. The synthetic musical sound 73 is obtained by synthesizing the musical sound 71 and the electronic musical sound 72. In the graph of FIG. 7, the vertical axis indicates volumes of the musical sound 71, the electronic musical sound 72, and the synthetic musical sound 73 while the horizontal axis indicates time.

When the struck surface plate 14 is struck, the musical sound 71 is produced from the moment of the striking and the vibration caused by the striking is transmitted to the first sensor 41 and the second sensor 42, and then the first sensor 41 and the second sensor 42 detect the vibration caused by the striking. For reasons that will be explained later, production of the musical sound 71 and the vibration detection performed by at least one of the first sensor 41 and the second sensor 42 occur substantially at the same time, which is set as a time t0. As shown in FIG. 7, the sound source device 50 causes the electronic musical sound 72 to be produced at a time t1 which is 4 msec later than the time t0, i.e. the timing the musical sound 71 is produced. The specific process is that the CPU 51 (the sound source device 50) sets the moment, in which at least one of the first sensor 41 and the second sensor 42 detects the vibration caused by the striking, as the time t0, and adjusts the timing such that the sounding body 60 produces the electronic musical sound 72 at the time t1, i.e. 4 msec later than the time t0, so as to give the sound production instruction to the sound source 55. The sound source 55 generates the musical signal corresponding to the sound production instruction and the sounding body 60 produces the electronic musical sound 72 based on the musical signal generated by the sound source 55.

Further, in order that the sounding body 60 produces the electronic musical sound 72 at the time t1, it is also possible to perform control to adjust the timing by the sound source 55, instead of the CPU 51, to send the musical signal from the sound source 55 to the sounding body 60. There is a time difference between the time the struck surface plate 14 is struck (production of the musical sound 71) and the time at least one of the first sensor 41 and the second sensor 42 detects the vibration caused by the striking. However, the time difference is sufficiently small compared with 4 msec and thus can be ignored. That is, in this embodiment, the production of the musical sound 71 and the vibration detection performed by at least one of the first sensor 41 and the second sensor 42 occur substantially at the same time.

Because the electronic musical sound 72 is produced at the time t1 which is 4 msec later than the time t0, i.e. the timing the musical sound 71 is produced, while the musical sound 71 and the electronic musical sound 72 form a series of musical sounds (the synthetic musical sound 73), the electronic musical sound 72 can be highlighted with respect to the musical sound 71. The difference between the time t0 and the time t1 is not limited to 4 msec. When the difference is in a range of 3-6 msec, likewise, the electronic musical sound 72 can be highlighted with respect to the musical sound 71 while the musical sound 71 and the electronic musical sound 72 form the series of synthetic musical sound 73. As a result, the expressiveness of the performance using the percussion instrument 10 can be enhanced.

Moreover, because the electronic musical sound 72 is produced at a time that is 3-6 msec (preferably 4 msec) later than at least one of the first sensor 41 and the second sensor 42 detects the vibration caused by the striking (the time t0), there is sufficient time for calculating the striking strength or determining the struck position. Accordingly, the striking strength can be calculated with high accuracy and the accuracy of determining the struck position can be ensured.

According to the percussion instrument 10 described above, an acoustic musical sound is produced when the struck surface plate 14 is struck and the sound source device 50 generates a musical signal according to the detection results of the first sensor 41 and the second sensor 42 that detect the vibration caused by the striking, and the sounding body 60 produces an electronic musical sound based on the musical signal. Because the sounding body 60 is disposed in the case 11, the musical sound produced by the vibration of the case 11 and the electronic musical sound can be produced from the one case 11. Accordingly, the expressiveness of the performance using the percussion instrument 10 can be enhanced.

Because the struck surface plate 14 has the sound emission hole 14*a*, the directions of the musical sound produced from the front side (surface on the near side of the paper surface of FIG. 1) of the struck surface plate 14 due to the vibration of the struck surface plate 14 and the musical sound emitted from the sound emission hole 14*a* can be aligned. Here, if a centerline that bisects the struck surface plate 14 into left and right parts is divided by the sound emission hole 14*a*, the sound quality of the musical sound produced by the vibration of the struck surface plate 14 will be significantly different from the sound quality of the musical sound produced by a struck surface plate 14 that has no sound emission hole 14*a* (a general cajon).

In this embodiment, the sound emission hole 14*a* is located on the right side with respect to the lateral center (the centerline that bisects the struck surface plate 14 into left and right parts) of the struck surface plate 14 in the front view. Therefore, the sound quality of the musical sound produced by the vibration of the struck surface plate 14 does not significantly differ from the sound quality of the musical sound produced by a struck surface plate 14 that has no sound emission hole 14*a*. Accordingly, the directions of the musical sound produced by the vibration of the struck surface plate 14 and the musical sound emitted from the sound emission hole 14*a* can be uniformized. Meanwhile, the sound quality of the musical sound produced by the vibration of the struck surface plate 14 can be close to the sound quality of the musical sound produced by a struck surface plate 14 that has no sound emission hole 14*a*.

In addition, for the percussion instrument 10 that is a cajon, there is a playing technique that the player strikes the struck surface plate 14 while pressing a foot against the struck surface plate 14 to produce a musical sound with the resonance or reverberation cut. Moreover, since the pitch of the musical sound becomes higher as the position pressed by the foot gets closer to the upper end of the struck surface plate 14, the foot pressed against the struck surface plate 14 may slide up and down. Particularly, it is common for the player to press the right foot against the left side of the struck surface plate 14 in the front view. Therefore, the sound emission hole 14*a* is located on the right side with respect to the lateral center of the struck surface plate 14 in the front view, so as to prevent the player's foot from being caught by the sound emission hole 14*a* while the player's foot slides up and down.

Because the opening areas of the sound emission hole 14*a* and the resonance hole 21*a* penetrating the case 11 are sufficiently small as compared with the volume of the case 11, the air inside the case 11 is compressed by the striking on the struck surface plate 14 and the sound emission hole 14*a* functions as the so-called bass reflex port. Accordingly, a predetermined frequency band (lower range) of the musical sound produced from the back side (the side of the rear surface plate 15) of the struck surface plate 14 by the vibration of the struck surface plate 14 can be enhanced by the sound emission hole 14*a*. Because the sounding body 60 is disposed inside the case 11, a predetermined frequency band (lower range) of the electronic musical sound produced by the sounding body 60 can be enhanced by the sound emission hole 14*a* as well. The frequency band enhanced by the sound emission hole 14*a* is determined based on the opening area of the sound emission hole 14*a*, the length of the sound emission hole 14*a* (the plate thickness of the struck surface plate 14), the volume of the case 11, and the distance between the sound emission hole 14*a* and the sounding body 60.

Because the opening areas of the sound emission hole 14*a* and the resonance hole 21*a* penetrating the case 11 are sufficiently small as compared with the volume of the case 11, the resonance hole 21*a* and the port 21*b* function as the so-called bass reflex port. Accordingly, a predetermined frequency band (lower range) of the musical sound (the musical sound and electronic musical sound from the back side of the struck surface plate 14) emitted from the inside to the outside of the case 11 can be enhanced by the resonance hole 21*a*. The frequency band enhanced by the resonance hole 21*a* and the port 21*b* is determined based on the minimum opening areas of the resonance hole 21*a* and the port 21*b*, the lengths of the resonance hole 21*a* and the port 21*b*, and the volume of the case 11. The frequency band that can enhance the musical sound (the musical sound and electronic musical sound from the back side of the struck surface plate 14) emitted from the inside to the outside of the case 11 can be expanded by differentiating the frequency band that can be enhanced by the sound emission hole 14*a* and the frequency band that can be enhanced by the resonance hole 21*a*.

Because the port 21*b* extends toward the upper surface plate 12 from the resonance hole 21*a* formed in the rear surface plate 15, that is, the port 21*b* extends in a direction intersecting the vibration direction of the struck surface plate 14 from the resonance hole 21*a* located opposite to the struck surface plate 14, the wind pressure generated inside the case 11 by the striking on the struck surface plate 14 can be dispersed by the port 21*b*. Accordingly, the influence that the wind pressure generated by the striking on the struck surface plate 14 causes to the sounding body 60 can be reduced. Furthermore, the musical sound from the back side of the struck surface plate 14 collides with the port 21*b* and is diffused. Thereby, it is possible to fully echo the musical sound from the back side of the struck surface plate 14 inside the case 11.

Because the center of the sounding body 60 is located on the inner side of the sound emission hole 14*a* when viewed from the sound axis direction of the sounding body 60, the electronic musical sound can be directly emitted from the sound emission hole 14*a* to the outside of the case 11. The sound is difficult to be diffracted as the frequency gets higher, and the sound with higher frequency is produced from the center side of the sounding body 60. According to the positional relationship between the sounding body 60 and the sound emission hole 14*a*, the middle to high-pitched electronic musical sound produced from the center side of the sounding body 60 can be emitted directly to the outside of the case 11 from the sound emission hole 14*a*. Thus, reduction of the middle to high-pitched electronic musical sound due to blocking of the case 11 can be suppressed.

Because the distance from the rear surface of the sounding body 60 to the rear surface plate 15 is set longer than the distance from the front surface of the sounding body 60 to the sound emission hole 14*a* (the struck surface plate 14), that is, the distance from the sounding body 60 to the sound emission hole 14*a* (70 mm in this embodiment) is set to be less than ½ of the distance from the struck surface plate 14 to the rear surface plate 15 (substantially equal to the depth of about 300 mm of the case 11 in this embodiment), the low-pitched electronic musical sound produced from the rear surface of the sounding body 60 can easily feedback to the front surface side of the sounding body 60. Accordingly, the low-pitched electronic musical sound produced from the rear surface of the sounding body 60 can be easily emitted to the outside of the case 11 from the sound emission hole 14*a*, and therefore the sound quality of the low-pitched electronic musical sound emitted from the sound emission hole 14*a* can be improved. In addition, because the distance from the sounding body 60 to the sound emission hole 14*a* is set to be ½ or less of the distance from the struck surface plate 14 to the rear surface plate 15, the sounding body 60 can be moved closer to the sound emission hole 14*a* to facilitate emitting the musical sound produced by the sounding body 60 from the sound emission hole 14*a* to the outside of the case 11.

On the other hand, as the distance from the sounding body 60 to the sound emission hole 14*a* decreases, the musical sound from the back side of the struck surface plate 14 or the electronic musical sound produced from the rear surface of the sounding body 60 will be blocked by the sounding body 60 and become difficult to be emitted to the outside of the case 11 from the sound emission hole 14*a*. By setting the distance from the sounding body 60 to the sound emission hole 14*a* to ⅙ or more of the distance from the struck surface plate 14 to the rear surface plate 15, the musical sound from the back side of the struck surface plate 14 or the electronic musical sound produced from the rear surface of the sounding body 60 can be easily emitted to the outside of the case 11 from the sound emission hole 14*a*.

Accordingly, by setting the distance from the sounding body 60 to the sound emission hole 14*a* to be ⅙ or more and less than ½ of the distance from the struck surface plate 14 to the rear surface plate 15, the sound quality of the low-pitched electronic musical sound can be improved, and the musical sound from the back side of the struck surface plate 14 and the electronic musical sound produced by the sounding body 60 can be emitted to the outside of the case 11 easily. More preferably, by setting the distance from the sounding body 60 to the sound emission hole 14*a* to be ⅕ or more and less than ⅓ of the distance from the struck surface plate 14 to the rear surface plate 15, the sound quality of the low-pitched electronic musical sound can be further improved, and the musical sound from the back side of the struck surface plate 14 and the electronic musical sound produced by the sounding body 60 can be emitted to the outside of the case 11 more easily.

Furthermore, the shock (vibration) generated when the struck surface plate 14 is struck imposes more influence on the sounding body 60 as the distance from the sounding body 60 to the struck surface plate 14 decreases. By setting the distance from the sounding body 60 to the struck surface plate 14 to ⅙ or more of the distance from the struck surface plate 14 to the rear surface plate 15, the influence on the sounding body 60 resulting from the shock of the striking on the struck surface plate 14 can be reduced. More preferably, the distance from the sounding body 60 to the sound emission hole 14*a* is set to ⅕ or more of the distance from the struck surface plate 14 to the rear surface plate 15, such that the influence on the sounding body 60 resulting from the shock of the striking on the struck surface plate 14 can be further reduced.

Moreover, because the middle to high-pitched electronic musical sound is not easily diffracted, as the distance from the sounding body 60 to the struck surface plate 14 increases, it becomes difficult for the middle to high-pitched electronic musical sound emitted from the sound emission hole 14*a* to expand. In addition, as the diameter of the sound emission hole 14*a* increases, it becomes easy for the middle to high-pitched electronic musical sound emitted from the sound emission hole 14*a* to expand.

The diameter of the sound emission hole 14*a* (about 90 mm in this embodiment) is set to be 1.0-1.5 times the distance between the sound emission hole 14*a* and the sounding body 60 (about 70 mm in this embodiment), such that the musical sound from the back side of the struck surface plate 14 or the electronic musical sound produced from the rear surface of the sounding body 60 can be easily emitted to the outside of the case 11 and the middle to high-pitched electronic musical sound can be expanded easily. More preferably, the diameter of the sound emission hole 14*a* is set to be 1.1-1.4 times the distance between the sound emission hole 14*a* and the sounding body 60. Even more preferably, the diameter of the sound emission hole 14*a* is set to be 1.2-1.3 times the distance between the sound emission hole 14*a* and the sounding body 60. Accordingly, the musical sound from the back side of the struck surface plate 14 or the electronic musical sound produced from the rear surface of the sounding body 60 can be easily emitted to the outside of the case 11 and the middle to high-pitched electronic musical sound can be expanded more easily.

Because the first sensor 41 detects the vibration of the struck surface plate 14 and the second sensor 42 detects the vibration of the first horizontal member 23 (a part different from the struck surface plate 14 of the case 11), the struck position can be determined based on an output result of the first sensor 41 and an output result of the second sensor 42. Because the musical signal of a tone corresponding to the struck position can be generated by the sound source device 50, the tone of the electronic musical sound can be changed according to the struck position to enhance the expressiveness of the performance using the percussion instrument 10.

Because the first sensor 41 detects vibration of the struck surface plate 14 in the vibration direction and the second sensor 41 detects vibration in the direction perpendicular to the vibration direction of the struck surface plate 14, the influence on the second sensor 42 caused by the vibration of the struck surface plate 14 can be suppressed. Consequently, erroneous detection of the second sensor 42 can be suppressed.

The center of the struck surface plate 14 and the upper end side (the side of the upper surface plate 12) of the struck surface plate 14 of the percussion instrument 10 are the positions that are mostly struck by the player. Compared with striking on the upper end side of the struck surface plate 14, the vibration of the struck surface plate 14 is large when the center of the struck surface plate 14 is struck. Therefore, the output value of the first sensor 41 that directly detects the vibration of the struck surface plate 14 can be increased. As a result, the first sensor 41 can easily detect the striking in the center of the struck surface plate 14.

Particularly, during performance, a right-handed player usually strikes the vertical center on the left side of the struck surface plate 14 in the front view with right hand at the first beat (downbeat). Because the first sensor 41 is located on the left side with respect to the lateral center of the struck surface plate 14 and located in the vertical center of the struck surface plate 14 in the front view, the distance from the struck position to the first sensor 41 can be shortened. The shock (vibration) transmitted to the first sensor 41 can be increased as the distance from the struck position to the first sensor 41 is shortened. Thus, the output value of the first sensor 41 can be increased and the first sensor 41 can accurately detect the right-handed player's striking of the first beat.

On the other hand, when the upper end side of the struck surface plate 14 is struck, because the second sensor 42 is attached to the first horizontal member 23, the distance from the struck position to the second sensor 42 can be shortened. The shock (vibration) transmitted from the struck position to the second sensor 42 can be increased. Hence, the output value of the second sensor 42 can be increased. As a result, the second sensor 42 can easily detect the striking on the upper end side of the struck surface plate 14.

Because the first sensor 41 is located on the left side with respect to the lateral center of the struck surface plate 14 in the front view and the second sensor 42 is located in the lateral center of the struck surface plate 14 in the front view, as the struck position of the struck surface plate 14 changes in the lateral direction, the output values of the first sensor 41 and the second sensor 42 increase or decrease (the position of the peak) in manners different from each other. Through comparison between the output result of the first sensor 41 and the output result of the second sensor 42, the accuracy of determination of the struck position in the lateral direction can be improved.

Besides, because the first sensor 41 is located in the vertical center of the struck surface plate 14 in the front view and the second sensor 42 is attached to the first horizontal member 23, the accuracy of determination of the struck position in the vertical direction can be improved through comparison between the output result of the first sensor 41 and the output result of the second sensor 42. As a result of the above, the accuracy of determination of the struck position performed by the first sensor 41 and the second sensor 42 can be improved.

Because the first support 25 and the second support 26, across which the support part 27 that supports the first sensor 41 is laid, and the first horizontal member 23 that supports the second sensor 42 are separated by a predetermined distance, it is possible to suppress the vibration generated when the struck surface plate 14 is struck from transmitting between the support part 27 and the first horizontal member 23 through the first support 25 and the second support 26. Since transmission of vibration between the parts that respectively support the first sensor 41 and the second sensor 42 can be suppressed, erroneous detection of the first sensor 41 and the second sensor 42 can be suppressed to ensure the detection accuracy.

In the front view, the first sensor 41 is located on the left side with respect to the lateral center of the struck surface plate 14 and in the vertical center of the struck surface plate 14 and the second sensor 42 is located in the lateral center of the struck surface plate 14 and on the upper end side of the struck surface plate 14. In contrast thereto, the center of the sounding body 60 is located on the right side with respect to the lateral center of the struck surface plate 14 in the front view and is closer to the side of the lower surface plate 13 than the first sensor 41. Because the sounding body 60 and the first sensor 41 and the second sensor 42 are separated by a distance, the issue that the first sensor 41 and the second sensor 42 may erroneously detect the vibration of the sounding body 60 can be prevented.

Because the operation member 18*a* is disposed on the upper surface plate 12 sat by the player, the player can easily operate the operation member 18*a* while sitting on the case 11 during performance. Because the sound source device 50 generates the musical signal according to the operation of the operation member 18*a* and the sounding body 60 produces the electronic musical sound based on the musical signal, the tone or volume of the electronic musical sound can be changed easily by operating the operation member 18*a* during the performance. Consequently, the expressiveness of the performance using the percussion instrument 10 can be enhanced.

Further, because the operation member 18*a* is disposed in the lateral center of the upper surface plate 12 on the side of the struck surface plate 14, when the player sits on the case 11 and faces the front in order to easily strike the struck surface plate 14 with both hands, the operation member 18*a* is near the player's crotch. Since the operation member 18*a* can be operated more easily during performance, the tone or volume of the electronic musical sound can be changed more easily during performance.

Next, the second embodiment is described with reference to FIG. 8. The first embodiment illustrates a case where the entire sounding body 60 is disposed inside the case 11. In contrast thereto, the second embodiment illustrates a case where a part of a sounding body 83 is disposed inside a case 81 while another part of the sounding body 83 is disposed outside the case 81. The same reference numerals are used to denote parts the same as those of the first embodiment. Thus, detailed descriptions thereof are not repeated hereinafter. Moreover, although the second embodiment does not include the sound emission hole 14*a* of the first embodiment, the resonance hole 21*a* and the port 21*b* can be treated as a sound emission hole.

Figure 8:
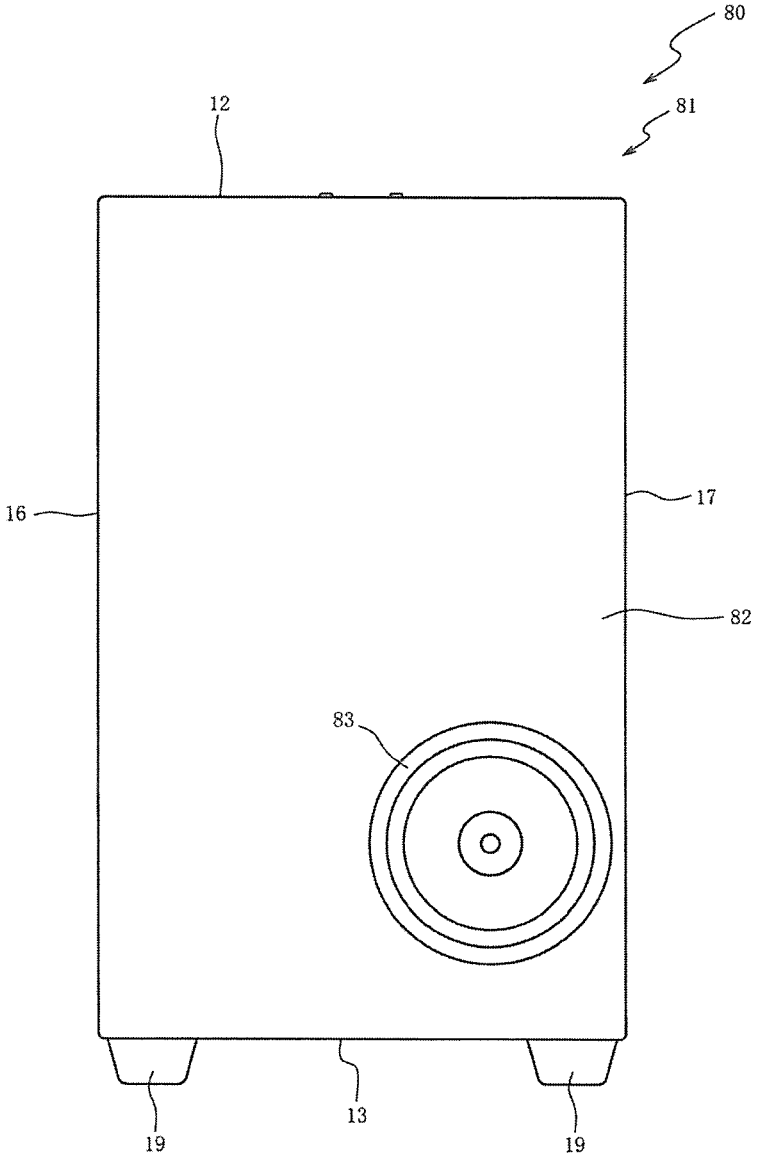
FIG. 8 is a front view of the percussion instrument according to the second embodiment.

FIG. 8 is a front view of a percussion instrument 80 according to the second embodiment. As shown in FIG. 8, the percussion instrument 80 is a cajon and includes the rectangular parallelepiped-shaped case 81 that is formed hollow by an upper surface plate 12, a lower surface plate 13, and a side surface plate. The side surface plate is composed of a struck surface plate 82 located in front (the near side of the paper surface of FIG. 8), a rear surface plate 15 opposite to the struck surface plate 82, a left surface plate 16, and a right surface plate 17.

When the player strikes the struck surface plate 82 while sitting on the upper surface plate 12, the entire case 81, particularly the struck surface plate 82, vibrates such that the percussion instrument 80 (the case 81) produces an acoustic musical sound. In addition, the percussion instrument 80 includes a mechanism for producing an electronic musical sound when the struck surface plate 82 is struck. Specifically, the percussion instrument 80 includes a first sensor 41 and a second sensor 42 (percussion sensors) for detecting the striking on the struck surface plate 82, a sound source device 50 for generating a musical signal according to detection results of the first sensor 41 and the second sensor 42, and the sounding body 83 for producing an electronic musical sound based on the musical signal generated by the sound source device 50.

The struck surface plate 82 is a wooden flat plate and is formed thinner than the upper surface plate 12, the lower surface plate 13, the rear surface plate 15, the left surface plate 16, and the right surface plate 17. Accordingly, the rigidity of the struck surface plate 82 is reduced to make it easy to vibrate the struck surface plate 82. A portion from an upper end (an end part on the side of the upper surface plate 12) to a vertical center of the struck surface plate 82 is a part primarily struck by the player. An opening (not shown), through which the sounding body 83 is disposed, is forming on the right side (the side of the right surface plate 17) with respect to a lateral center of the struck surface plate 82 and on the lower side (the side of the lower surface plate 13) with respect to the vertical center of the struck surface plate 82 in the front view.

The sounding body 83 is a cone type speaker that has a circular shape in the front view. A part of the sounding body 83 is disposed inside the case 81 while another part protrudes outside the case 81 through the opening of the struck surface plate 82, so as to prevent the contact with the sounding body 83 from interfering with the vibration of the struck surface plate 82.

The sounding body 83 is supported by the inside of the case 81 with the front surface facing the front (the near side of the paper surface) such that a sound axis thereof is perpendicular to the struck surface plate 82. Accordingly, the direction of the musical sound produced by the vibration of the struck surface plate 82 and the direction of the electronic musical sound produced by the sounding body 83 can be uniformized.

According to the percussion instrument 80 as described above, the sounding body 83 is disposed on the case 81 through the struck surface plate 82 such that the front surface of the sounding body 83 is located outside the case 81. Therefore, it is possible to prevent the case 81 from interfering with the electronic musical sound produced from the front surface of the sounding body 83. Consequently, the electronic musical sound can be expanded widely without changing the sound quality of the electronic musical sound, which may occur due to interference of the case 81.

When the sounding body 83 is disposed on the case 81 through the struck surface plate 82, the opening that penetrates the struck surface plate 82 is on the right side (the side of the right surface plate 17) with respect to the lateral center of the struck surface plate 82 and on the lower side (the side of the lower surface plate 13) with respect to the vertical center of the struck surface plate 82 in the front view. Thus, a centerline that bisects the struck surface plate 82 into left and right parts is not divided by the opening of the struck surface plate 82. It is possible to make the sound quality of the musical sound produced by the vibration of the struck surface plate 82 not so different from the sound quality of the musical sound produced by a struck surface plate 82 without an opening. Accordingly, even though the sounding body 83 is disposed on the case 81 through the right side with respect to the lateral center of the struck surface plate 82 in the front view, the sound quality of the musical sound produced by the vibration of the struck surface plate 82 can be close to that produced by a struck surface plate 82 that has no opening. In addition, because the sounding body 83 is disposed through the right side with respect to the lateral center of the struck surface plate 82, when the player performs the playing technique of pressing the right foot against the left side of the struck surface plate 82 in the front view, the player's foot is not easily caught by the sounding body 83.

Next, the third embodiment is described with reference to FIG. 9 to FIG. 12. The first embodiment illustrates a case where the percussion instrument 10 is a cajon. In contrast thereto, the third embodiment illustrates a case where a percussion instrument 90 is a bongo. The same reference numerals are used to denote parts the same as those of the first embodiment. Thus, detailed descriptions thereof are not repeated hereinafter. In addition, the bongo refers to an instrument that is generally formed by splicing two single-sided drums of different sizes. In this embodiment, however, one of the two single-sided drums of different sizes is described while the description of the other is omitted.

Figure 9:
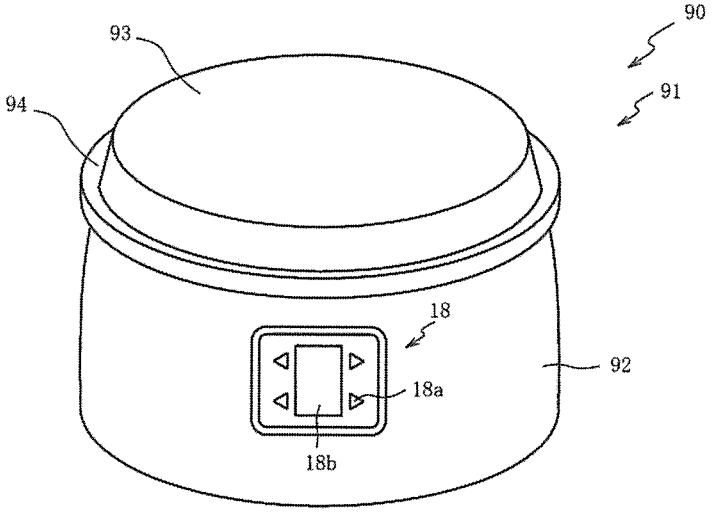
FIG. 9 is a front perspective view of the percussion instrument according to the third embodiment.
Figure 10:
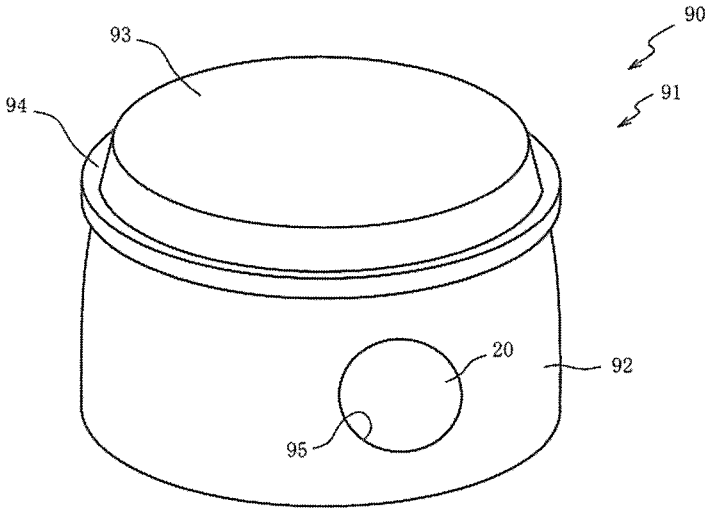
FIG. 10 is a rear perspective view of the percussion instrument.

First, a schematic configuration of the percussion instrument 90 is described with reference to FIG. 9 and FIG. 10. FIG. 9 is a front perspective view of the percussion instrument 90 according to the third embodiment and FIG. 10 is a rear perspective view of the percussion instrument 90. As shown in FIG. 9 and FIG. 10, the percussion instrument 90 is a bongo and includes a case 91, in which an end of a cylindrical shell 92 is closed by a membranous struck surface part 93 made of leather. An outer peripheral edge of the struck surface part 93 is fixed to an outer peripheral surface of the shell 92 by a hoop 94. When the player strikes the struck surface part 93, the entire case 91, particularly the struck surface part 93, vibrates such that the percussion instrument 90 produces an acoustic musical sound.

The shell 92 is a member made of a synthetic resin and is provided with an operation panel 18 that includes an operation member 18*a* to be operated by the player and a display device 18*b* for displaying an operation state of the operation member 18*a*. On the shell 92, a sound emission hole 95 is formed on a side opposite to where the operation panel 18 is disposed. Considering the appearance, the sound emission hole 95 is covered by a meshed sheet 20 to make it difficult to see the inside of the case 91.

Figure 11:
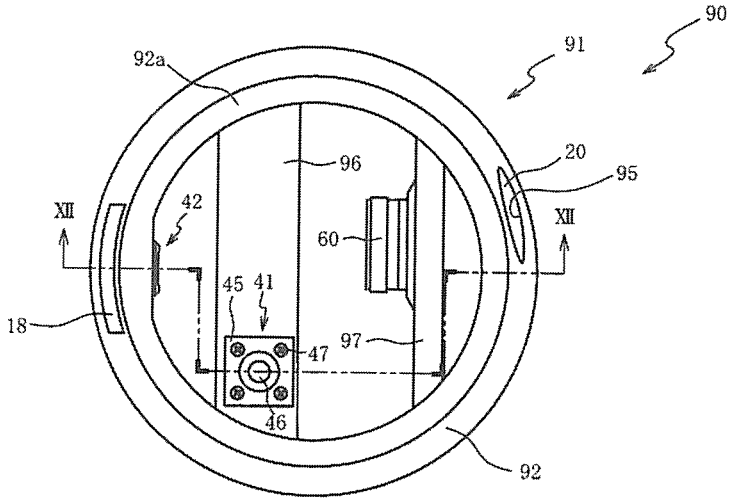
FIG. 11 is a top view of the percussion instrument with the struck surface part removed.
Figure 12:
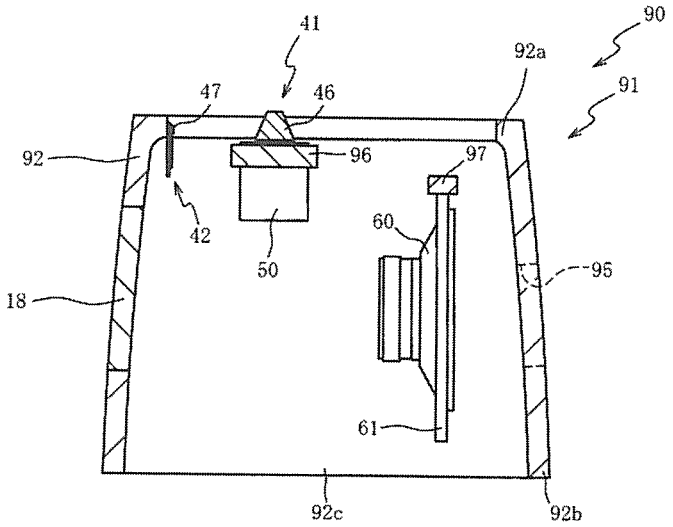
FIG. 12 is a cross-sectional view of the percussion instrument along the line XII-XII of FIG. 11.

Next, an internal structure of the percussion instrument 90 is described with reference to FIG. 11 and FIG. 12. FIG. 11 is a top view of the percussion instrument 90 with the struck surface part 93 removed and FIG. 12 is a cross-sectional view of the percussion instrument 90 along the line XII-XII of FIG. 11. In this embodiment, the near side of the paper surface of FIG. 11 is referred to as the top of the percussion instrument 90, the left side of FIG. 11 is referred to as the front of the percussion instrument 90, and the upper side of FIG. 11 is referred to as the left of the percussion instrument 90. In this case, the struck surface part 93 is the upper surface of the case 91 and the shell 92 is the side surface of the case 91.

As shown in FIG. 11 and FIG. 12, the percussion instrument 90 includes a mechanism for producing an electronic musical sound when the struck surface part 93 is struck (see FIG. 9). Specifically, the percussion instrument 90 includes a first sensor 41 and a second sensor 42 (percussion sensors) for detecting the striking on the struck surface part 93, a sound source device 50 for generating a musical signal according to detection results of the first sensor 41 and the second sensor 42, and a sounding body 60 for producing an electronic musical sound based on the musical sound generated by the sound source device 50.

An upper end of the shell 92 is a first end part 92*a* closed by the struck surface part 93 and a lower end of the shell 92 is a second end part 92*b*, wherein the second sensor 42 is attached to the first end part 92*a* for detecting vibration in a radial direction of the shell 92. A surface of the case 91 on the side of the first end part 92*a* is the struck surface part 93, as described above, and a surface of the case 91 on the side of the second end part 92*b* is completely opened. An opening of the case 91 on the side of the second end part 92*b* is a resonance hole 92*c*. The percussion instrument 90 produces a sound by the inside of the case 91 with the struck surface part 93 as a fixed end, the resonance hole 92*c* as a free end, and the shell 92 as a pipe, and can enhance a musical sound of a predetermined frequency band and a harmonic overtone thereof.

The shell 92 is formed such that outer and inner diameters thereof gradually increase from the first end part 92*a* to the second end part 92*b*, and a thickness of the first end part 92*a* (radial dimension) is formed greater than a thickness on the side of the second end part 92*b*. A first support part 96 and a second support part 97 are laid across an inner peripheral surface of the shell 92 on the side of the second end part 92*b* with respect to the first end part 92*a*.

The first support part 96 and the second support part 97 are wooden bar-shaped square materials with two ends bonded to the inner peripheral surface of the shell 92 by an adhesive, such that the first support part 96 and the second support part 97 each has one surface parallel to the struck surface part 93. The first sensor 41 is attached to the surface of the first support part 96 on the side of the first end part 92*a* and the sound source device 50 is attached to the surface of the first support part 96 on the side of the second end part 92*b*. The second support part 97 is located on the side of the sound emission hole 95 with respect to the first support part 96 in the top view. The sounding body 60 is attached to the surface of the second support part 97 on the side of the second end part 92*b* through a sounding body support part 61.

The first sensor 41 is in contact with the struck surface part 93 through a cushioning material 46 for detecting vibration of the struck surface part 93 and is located on the right side with respect to a lateral center of the case 91. The second sensor 42 is a sensor for detecting vibration of the shell 92 (a part different from the struck surface part 93 of the case 91). The second sensor 42 is attached in a cantilevered state to a position where the operation panel 18 is disposed in a circumferential direction of the shell 92 and is located in the lateral center of the case 91.

The sounding body 60 is supported by the sounding body support part 61 with the sound axis in parallel to the struck surface part 93, and the center of the sounding body 60 is located on the left side with respect to the lateral center of the case 91. The sounding body 60 is disposed such that, when viewed from the sound axis direction, the center of the sounding body 60 is located on the inner side of the sound emission hole 95.

According to the percussion instrument 90 as described above, an acoustic musical sound is produced when the struck surface part 93 is struck and the sound source device 50 generates a musical signal according to detection results of the first sensor 41 and the second sensor 42 that detect the vibration caused by the striking, and the sounding body 60 produces an electronic musical sound based on the musical signal. Because the sounding body 60 is disposed in the case 91, the musical sound produced by the vibration of the case 91 and the electronic musical sound can be produced from the one case 91. Accordingly, the expressiveness of the performance using the percussion instrument 90 can be enhanced.

It is preferable that the player plays the percussion instrument 90 with the operation panel 18 facing the player (the player is in front of the percussion instrument 90). In this case, because the sound axis direction of the sounding body 60 is oriented toward the front of the player (audience side) and the sound emission hole 95 is formed on the side (audience side) opposite to where the operation panel 18 is disposed, the electronic musical sound produced by the sounding body 60 can be emitted toward the front of the player through the sound emission hole 95.

In addition, because the configuration puts the center of the sounding body 60 on the inner side of the sound emission hole 95 when it is viewed from the sound axis direction, the electronic musical sound can be directly emitted to the outside of the case 91 through the sound emission hole 95. Since the middle to high-pitched electronic musical sound produced from the center side of the sounding body 60 can be emitted directly to the outside of the case 91 through the sound emission hole 95, reduction of the middle to high-pitched electronic musical sound resulting from blocking of the case 91 can be suppressed.

Moreover, when the percussion instrument 90 is played with the operation panel 18 facing the player, the first sensor 41 is located on the right side of the struck surface part 93 when viewed from the player. Hence, the output value of the first sensor 41 that is obtained when the right side of the struck surface part 93 is struck can be increased. Because a right-handed player usually strikes the right side of the struck surface part 93 with right hand at the first beat (downbeat), the distance from the struck position to the first sensor 41 can be shortened to increase the output value of the first sensor 41. As a result, the first sensor 41 can accurately detect the right-handed player's striking of the first beat.

When striking an edge of the struck surface part 93, the player usually strikes the edge of the struck surface part 93 on the player side. If the percussion instrument 90 is played with the operation panel 18 facing the player, the second sensor 42 is on the player side of the shell 92. Therefore, when the player strikes the edge of the struck surface part 93 on the player side, the distance from the struck position to the second sensor 42 can be shortened to increase the output value of the second sensor 42. Consequently, the striking on the edge of the struck surface part 93 can be detected easily.

Because the opening areas of the sound emission hole 95 and the resonance hole 92*c* are sufficiently large as compared with the volume of the case 91, the air inside the case 91 is hardly compressed by the striking on the struck surface part 93. Since it is not required to release the wind pressure generated by the striking on the struck surface part 93 to the outside of the case 91 from the sound emission hole 95, the sounding body 60 can be disposed close to the sound emission hole 95. By disposing the sounding body 60 close to the sound emission hole 95, the issue that the case 91 may block the electronic musical sound emitted by the sounding body 60 can be prevented.

The shell 92 is forming such that the second end part 92*b* has a reduced inner diameter, and the second end part 92*b* is closed and the resonance hole 92*c* is formed in a portion of the closed part, so as to reduce the opening area of the resonance hole 92*c*. Thereby, it is possible to make the air inside the case 91 be compressed by the striking on the struck surface part 93. In this case, the sound emission hole 95 and the resonance hole 92*c* function as the so-called bass reflex port.

Figure 13:
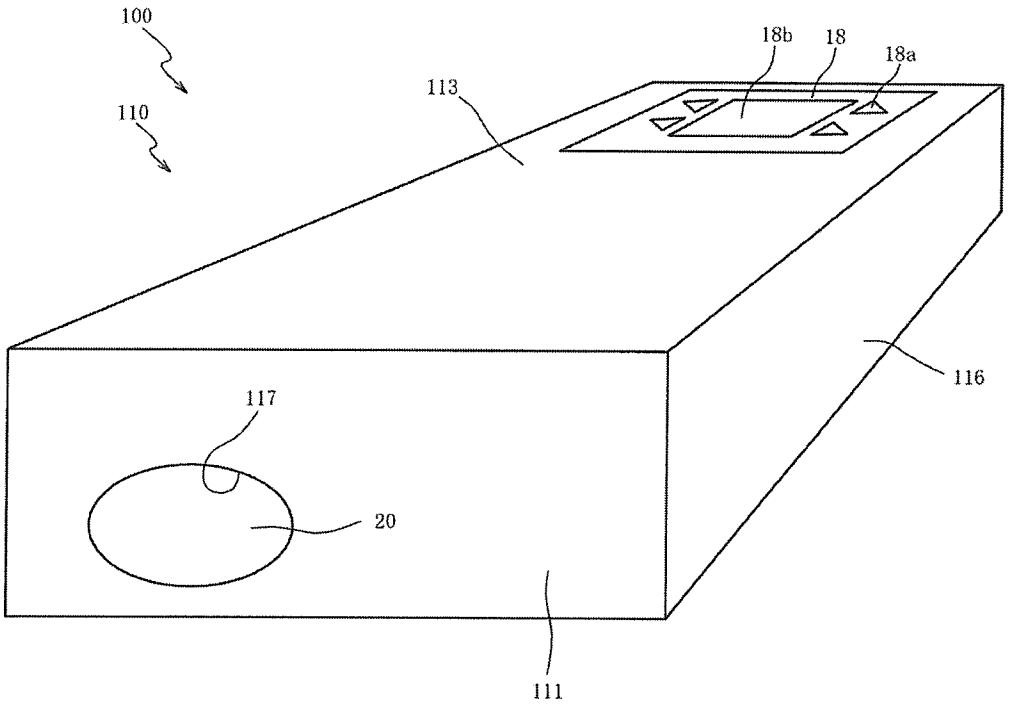
FIG. 13 is a perspective view of the percussion instrument according to the fourth embodiment.

Next, the fourth embodiment is described with reference to FIG. 13 to FIG. 15. The first embodiment illustrates a case where the percussion instrument 10 is a cajon. In contrast thereto, the fourth embodiment illustrates a case where a percussion instrument 100 is a cowbell. The same reference numerals are used to denote parts the same as those of the first embodiment. Thus, detailed descriptions thereof are not repeated hereinafter. FIG. 13 is a perspective view of the percussion instrument 100 according to the fourth embodiment, FIG. 14 is a top view of the percussion instrument 100 through a struck surface plate 113, and FIG. 15 is a cross-sectional view of the percussion instrument 100 along the line XV-XV of FIG. 14.

Figure 14:
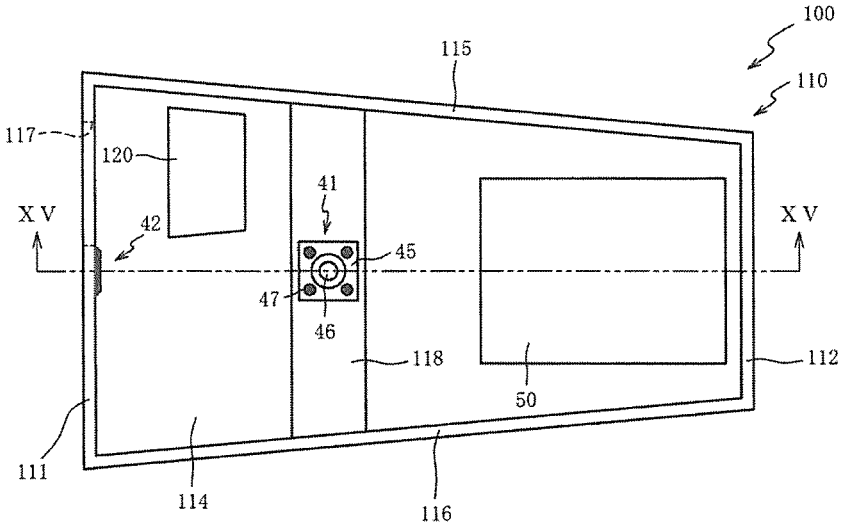
FIG. 14 is a top view of the percussion instrument through the struck surface plate.
Figure 15:
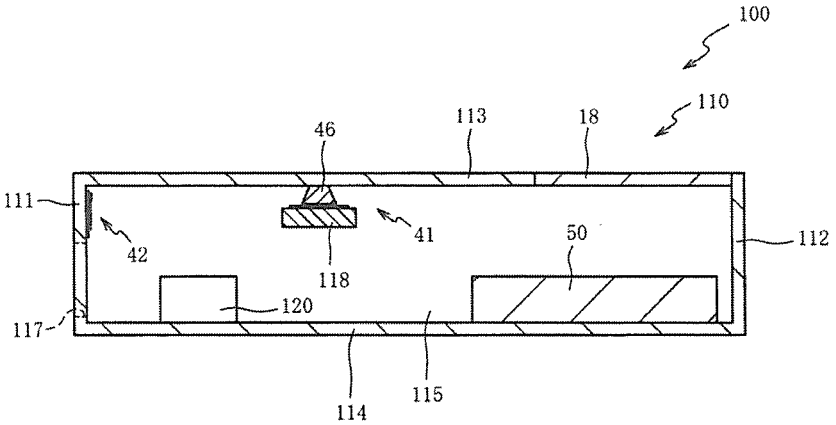
FIG. 15 is a cross-sectional view of the percussion instrument along the line XV-XV of FIG. 14.

As shown in FIG. 13 to FIG. 15, the percussion instrument 100 is a cowbell and includes a hexahedral metallic case 110 having one surface as the struck surface plate (struck surface part) 113, a first sensor 41 and a second sensor 42 (percussion sensors) for detecting the striking on the struck surface plate 113, a sound source device 50 for generating a musical signal according to detection results of the first sensor 41 and the second sensor 42, and a sounding body 120 for producing an electronic musical sound based on the musical signal generated by the sound source device 50.

The case 110 has a rectangular first surface plate 111, a rectangular second surface plate 112 opposite to the first surface plate 111, the quadrangular struck surface plate 113 connecting the first surface plate 111 and the second surface plate 112 on one side, a quadrangular third surface plate 114 opposite to the struck surface plate 113, a rectangular fourth surface plate 115 connecting the first surface plate 111, the second surface plate 112, the struck surface plate 113, and the third surface plate 114 on one side, and a fifth surface plate 116 opposite to the fourth surface plate 115. To facilitate the description, in this embodiment, a direction in which the first surface plate 111 and the second surface plate 112 are opposite to each other is referred to as a front-rear direction, a direction in which the struck surface plate 113 and the third surface plate 114 are opposite to each other is referred to as a vertical direction, and a direction in which the fourth surface plate 115 and the fifth surface plate 116 are opposite to each other is referred to as a lateral direction.

The first surface plate 111 is a metallic flat plate that is long in the lateral direction. The first surface plate 111 has an elliptical sound emission hole 117 that is formed on the side of the third surface plate 114 and on the side of the fourth surface plate 115 with respect to a lateral center of the first surface plate 111. The second sensor 42 for detecting vibration of the first surface plate 111 is attached to an inner side (a surface on the side of the second surface plate 112) of the first surface plate 111. The second sensor 42 is located on the side of the struck surface plate 113 with respect to the sound emission hole 117. The sound emission hole 117 is an opening for releasing a wind pressure that is generated inside the case 110 by the striking on the struck surface plate 113 to the outside of the case 110. Considering the appearance, the sound emission hole 117 is covered by a meshed sheet 20 to make it difficult to see the inside of the case 110. Because the opening area of the sound emission hole 117 is sufficiently small as compared with the volume of the case 110, the sound emission hole 117 functions as the so-called bass reflex port.

The second surface plate 112 is a metallic flat plate that is long in the lateral direction and has a smaller lateral dimension than the first surface plate 111. Accordingly, a cross-sectional area of the case 110 increases from the second surface plate 112 to the first surface plate 111.

The struck surface plate 113 is a metallic flat plate, on which an operation panel 18 is disposed on the side of the second surface plate 112 with respect to a front-rear center and in the lateral center. The side of the first surface plate 111 with respect to the front-rear center is a part primarily struck by the player. The third surface plate 114 is a metallic flat plate. The sound source device 50 is disposed on an inner side (a surface on the side of the struck surface plate 113) of the third surface plate 114 and the sounding body 120 is attached to the inner side of the third surface plate 114. The sound source device 50 is located on the side of the second surface plate 112 with respect to the front-rear center of the third surface plate 114 and in the lateral center of the third surface plate 114. The sounding body 120 is located on the side of the first surface plate 111 with respect to the front-rear center of the third surface plate 114 and on the side of the fourth surface plate 115 with respect to the lateral center of the third surface plate 114.

The fourth surface plate 115 and the fifth surface plate 116 are metallic flat plates that are long in the front-rear direction. A square bar-shaped support part 118 is laid across the fourth surface plate 115 and the fifth surface plate 116 on the inner side in the front-rear center and is separated from the struck surface plate 113 by a predetermined distance. The first sensor 41 is attached to the lateral center of a surface of the support part 118 on the side of the struck surface plate 113. The first sensor 41 is in contact with the struck surface plate 113 through a cushioning material 46 for detecting the vibration of the struck surface plate 113.

The sounding body 120 is an elliptical cone type speaker, and power is supplied from the sound source device 50. The sounding body 120 is disposed between the first sensor 41 and the second sensor 42 at substantially equal distances from the first sensor 41 and the second sensor 42. The sounding body 120 is separated from the sound emission hole 117 by a predetermined distance. Accordingly, the wind pressure generated by the striking on the struck surface plate 113 can be released to the outside of the case 110 through the sound emission hole 117.

The sounding body 120 is disposed with the front surface facing the first surface plate 111, such that the sound axis thereof is perpendicular to the first surface plate 111. The center of the sounding body 120 is located on an inner side of the sound emission hole 117 when viewed from the sound axis direction (the front-rear direction). Because the electronic musical sound produced by the sounding body 120 can be emitted directly to the outside of the case 110 through the sound emission hole 117, reduction of the middle to high-pitched electronic musical sound due to blocking of the case 110 can be suppressed.

According to the percussion instrument 100 as described above, an acoustic musical sound is produced when the struck surface plate 113 is struck and the sound source device 50 generates a musical signal according to the detection results of the first sensor 41 and the second sensor 42 that detect the vibration caused by the striking, and the sounding body 120 produces an electronic musical sound based on the musical signal. Because the sounding body 120 is disposed in the case 110, the musical sound produced by the vibration of the case 110 and the electronic musical sound can be produced from the one case 110. Accordingly, the expressiveness of the performance using the percussion instrument 100 can be enhanced.

For the percussion instrument 100, i.e. cowbell, there are a playing technique of striking the front-rear center of the struck surface plate 113 and a playing technique of striking an edge of the struck surface plate 113 on the side of the first surface plate 111. Since the first sensor 41 is located in the front-rear center of the struck surface plate 113, the striking on the front-rear center of the struck surface plate 113 can be easily detected by the first sensor 41. In addition, since the second sensor 41 is attached to the first surface plate 111, the striking on the edge of the struck surface plate 113 on the side of the first surface plate 111 can be easily detected by the second sensor 42.

In terms of methods of playing the percussion instrument 100, i.e. cowbell, there are a method of holding the percussion instrument 100 by one hand with the third surface plate 114 facing the palm for striking the struck surface plate 113 using a stick or the like (not shown), and a method of attaching a support tool (not shown) disposed on the second surface plate 112 to a stand (not shown) for striking the struck surface plate 113 with a stick or the like. When the player holds the percussion instrument 100 with one hand, since the operation member 18*a* is disposed on the struck surface plate 113, the player can easily operate the operation member 18*a* during the performance. Consequently, the player can operate the operation member 18*a* during performance to change the tone or volume of the electronic musical sound easily.

The sounding body 120 is disposed on the side of the fourth surface plate 115 with respect to the lateral center of the struck surface plate 113 at substantially equal distances to the first sensor 41 and the second sensor 42 disposed in the lateral center of the struck surface plate 113. Thus, the distances between the sounding body 120 and the first sensor 41 and the second sensor 42 can be ensured. As a result, the issue that the first sensor 41 and the second sensor 42 may erroneously detect the vibration of the sounding body 120 can be prevented.

The above illustrates the invention on the basis of the exemplary embodiments. However, it should be understood that the invention is not limited to any of the exemplary embodiments, and various modifications or alterations may be made without departing from the spirit of the invention. For instance, the positions of the operation panel 18, the sound emission hole 14*a*, 95, 117, the first sensor 41, the second sensor 42, the sound source device 50, and the sounding body 60, 83, 120 are exemplary, and it is certainly possible to change the configuration. Particularly, in the embodiments, the parts and devices are arranged to be suited to a right-handed player. The configuration of the parts and devices can be reversed in the lateral direction for a left-handed player.

The percussion instruments 10 and 80 illustrated in the first and second embodiments are cajons, the percussion instrument 90 illustrated in the third embodiment is a bongo, and the percussion instrument 100 illustrated in the fourth embodiment is a cowbell. However, the invention is not necessarily limited thereto. It is certainly possible to apply the invention to percussion instruments such as conga or drum, and timbales. The configuration for conga or drum, timbales, etc. is substantially the same as that for the bongo of the third embodiment. In addition to the cajon that the player sits on the upper surface plate 12 to strike the struck surface plate 14, i.e. the side surface of the case 11, the invention may also be applied to a cajon that uses the upper surface of the case as the struck surface plate. The configuration for the cajon that uses the upper surface of the case as the struck surface plate is substantially the same as that for the bongo of the third embodiment.

In the above embodiments, at least a part of the sounding body 60, 83, 120 is disposed inside the case 11, 81, 91, 110. However, the invention is not necessarily limited thereto. It is certainly possible to expose the entire sounding body 60, 83, 120 outside the case 11, 81, 91, 110. Moreover, the sounding body 60, 83, 120 may be disposed at a different location from the case 11, 81, 91, 110. Furthermore, not only the sounding body 60, 83, 120, the entire sound source device 50 may be exposed outside the case 11, 81, 91, 110, or the sound source device 50 may be disposed at a different location from the case 11, 81, 91, 110.

In the first, third, and fourth embodiments described above, the center of the sounding body 60, 120 is located on the inner side of the sound emission hole 14*a*, 95, 117 when viewed from the sound axis direction. However, the invention is not necessarily limited thereto. It is certainly possible to dispose the center of the sounding body 60, 120 on the outer side of the sound emission hole 14*a*, 95, 117 when viewed from the sound axis direction. In such a case, the middle to high-pitched electronic musical sound produced by the sounding body 60, 120 is difficult to be emitted to the outside of the case 11, 91, 110 and the low-pitched electronic musical sound can be emphasized. Moreover, it is possible to put the sound axis direction of the sounding body 60, 120 in a direction different from the surface where the sound emission hole 14*a*, 95, 117 is formed. In such a case, it will be even more difficult for the middle to high-pitched electronic musical sound to be emitted to the outside of the case 11, 91, 110 and the low-pitched electronic musical sound can be further emphasized.

In the first and third embodiments described above, the sound emission holes 14*a* and 95 are circular; and in the fourth embodiment, the sound emission hole 117 is elliptical. However, the invention is not necessarily limited thereto. It is certainly possible to form the sound emission hole 14*a*, 95, 117 into an oval shape or a polygonal shape, a semicircular shape, a crescent shape, or a combination of the foregoing. Furthermore, the sound emission hole 14*a*, 95, 117 is not necessarily covered by the sheet 20 and the sheet 20 may be omitted. In such a case, the influence that the sheet 20 may impose on the musical sound emitted to the outside of the case 11, 91, 110 through the sound emission hole 14*a*, 95, 117 can be eliminated.

In the above embodiments, two percussion sensors (the first sensor 41 and the second sensor 42) are disposed for detecting the striking on the struck surface plate 14, 82, 113 (struck surface part 93). However, the invention is not necessarily limited thereto. It is certainly possible to dispose one or three or more percussion sensors. By disposing three or more percussion sensors, the accuracy of determining the struck position through comparison of the detection results of the percussion sensors can be improved. Besides, the percussion sensors can be disposed at positions where the percussion instrument 10, 80, 90, 100 is frequently struck by the player, so as to detect the striking easily.

In the above embodiments, the vibration detecting elements of the first sensor 41 and the second sensor 42 are the piezoelectric elements 43. However, the invention is not necessarily limited thereto. It is certainly possible to use electrodynamic or electrostatic capacitance contact type detecting elements. In addition to contact type detecting elements, non-contact type detecting elements may also be used.

In the above embodiments, the first sensor 41 is in contact with the struck surface plate 14, 82, 113 (struck surface part 93) through the cushioning material 46. However, the invention is not necessarily limited thereto. It is also possible to directly attach the first sensor 41 to the struck surface plate 14, 82, 113 (the struck surface part 93).

In the above embodiments, the vibration detection direction of the first sensor 41 (the vibration direction of the struck surface plate 14, 82, 113 (the struck surface part 93) and the vibration detection direction of the second sensor 42 are perpendicular to each other. However, the invention is not necessarily limited thereto. It is certainly possible to set an angle between the vibration detection direction of the first sensor 41 and the vibration detection direction of the second sensor 42 to 0 degree or more and less than 90 degrees. If the angle between the vibration detection direction of the first sensor 41 and the vibration detection direction of the second sensor 42 is 60 degrees or more, the influence on the second sensor 42 caused by the vibration of the struck surface plate 14, 82, 113 (the struck surface part 93) can be suppressed to prevent erroneous detection of the second sensor 42.

In the first and second embodiments described above, the cases 11 and 81 are rectangular parallelepipeds. However, the invention is not necessarily limited thereto. For instance, it is certainly possible to use a case 11, 81 that the connection parts between the edges of the upper surface plate 12, the lower surface plate 13, the struck surface plate 14, 82, the rear surface plate 15, the left surface plate 16, and the right surface plate 17 are chamfered into a planar or curved shape. Moreover, the case 11, 81 may have a polygonal shape or a circular shape in a plan view or have a truncated pyramidal shape. The plates 12, 13, 14, 15, 16, and 17 may also be curved plates.

In the first embodiment described above, the edges of the upper surface plate 12, the lower surface plate 13, the rear surface plate 15, the left surface plate 16, and the right surface plate 17 are connected by the reinforcing members 22 and the edges of the struck surface plate 14 are respectively attached to the first horizontal member 23 on the upper surface plate 12, the second horizontal member 24 on the lower surface plate 13, the first support 25 on the left surface plate 16, and the second support 26 on the right surface plate 17 to form the case 11. However, the invention is not necessarily limited thereto. It is certainly possible to adjust the thicknesses of the plates 12, 13, 15, 16, and 17, so as to directly connect the edges of the plates 12, 13, 15, 16, and 17. In such a case, the struck surface plate 14 is attached to end surfaces of the upper surface plate 12, the lower surface plate 13, the left surface plate 16, and the right surface plate 17, and the second sensor 42 is attached to the upper surface plate 12 directly.

In the first embodiment, the sounding body support part 61 is a plate-shaped member. However, the invention is not necessarily limited thereto. It is certainly possible to form the sounding body support part 61 into a box shape to cover the rear surface of the sounding body 60. The sound quality of the electronic musical sound emitted to the outside of the case 11 can be adjusted by forming the sounding body support part 61 into a box shape or adjusting the dimensions of the plate-shaped or box-shaped sounding body support part 61.

What is claimed is:

1. A percussion instrument, comprising:

a case, wherein a struck surface part that vibrates to produce a musical sound when struck is disposed on at least a surface of the case;

a percussion sensor detecting striking corresponding to a struck position on the struck surface part;

a sound source device generating a musical signal corresponding to the struck position according to a detection result of the percussion sensor; and a sounding body producing an electronic musical sound based on the musical signal generated by the sound source device, wherein the sounding body is disposed in the case, and the case comprises a sound emission hole that penetrates a predetermined surface of the case, wherein the percussion sensor comprises a first sensor that detects a vibration of the struck surface part and a second sensor that detects a vibration of a part different from the struck surface part of the case, and the struck position is determined based on an output result of the first sensor and an output result of the second sensor.

2. The percussion instrument according to claim 1, wherein the second sensor comprises:

a supported part supported by the part different from the struck surface part of the case;

a swing part extending from the supported part to swing with respect to the supported part; and a detecting element having at least a part disposed on the swing part and detecting a vibration of the swing part in a swing direction.

3. The percussion instrument according to claim 1, wherein the sound source device causes the electronic musical sound to be produced from the sounding body at a timing that is 3-6 msec later than a timing when the struck surface part is struck to produce the musical sound.

4. The percussion instrument according to claim 1, wherein the sounding body is disposed inside the case at a predetermined distance from the sound emission hole.

5. The percussion instrument according to claim 4, wherein a center of the sounding body is located inside of the sound emission hole when viewed from a sound axis direction.

6. The percussion instrument according to claim 4, wherein the predetermined distance from the sounding body to the sound emission hole is set to be ⅙ or more and less than ½ of a distance from the struck surface part to a rear surface part, which is a part of the case and is opposite to the struck surface part.

7. The percussion instrument according to claim 4, wherein a diameter of the sound emission hole is set to be 1.0-1.5 times a distance between the sound emission hole and the sounding body.

8. The percussion instrument according to claim 1, wherein the case comprises a resonance hole that penetrates a surface of the case, which is different from the surface where the sound emission hole is formed.

9. The percussion instrument according to claim 8, wherein at least a part of the sounding body is disposed inside the case, the resonance hole is disposed at a position opposite to the struck surface part and a cylindrical port is connected to the resonance hole, and the port extends from the resonance hole into the case in a direction that intersects a vibration direction of the struck surface part.

10. A cajon, comprising:

a case on which a struck surface plate that vibrates to produce a musical sound when struck is disposed;

a percussion sensor detecting striking on the struck surface plate;

an operation member to be operated by a player;

a sound source device generating a musical signal according to a detection result of the percussion sensor and an operation of the operation member; and a sounding body producing an electronic musical sound based on the musical signal generated by the sound source device, wherein the case comprises an upper surface plate to be sat on by the player, a lower surface plate opposite to the upper surface plate, and a side surface plate connecting the upper surface plate and the lower surface plate, the struck surface plate is a part of the side surface plate, and the operation member is disposed on the upper surface plate.

11. A cajon, comprising:

a case, wherein a struck surface plate that vibrates to produce a musical sound when struck is disposed on a front surface of the case;

a percussion sensor detecting striking corresponding to a struck position on the struck surface plate;

a sound source device generating a musical signal corresponding to the struck position according to a detection result of the percussion sensor; and a sounding body producing an electronic musical sound based on the musical signal generated by the sound source device, wherein the case comprises an upper surface plate, a lower surface plate opposite to the upper surface plate, and a side surface plate connecting the upper surface plate and the lower surface plate, the struck surface plate is a part of the side surface plate, and the percussion sensor comprises a first sensor that detects a vibration of the struck surface plate, and a second sensor that is attached to the upper surface plate to detect a vibration of the upper surface plate, and the struck position is determined based on an output result of the first sensor and an output result of the second sensor.

12. The cajon according to claim 11, wherein the case comprises a first horizontal member disposed on the upper surface plate along an edge on a side of the struck surface plate, a second horizontal member disposed on the lower surface plate along an edge on the side of the struck surface plate, and a pair of supports disposed on the side surface plate along an edge on the side of the struck surface plate and extending vertically from the second horizontal member to be separated from the first horizontal member by a predetermined distance, a support part is laid across the pair of supports, and the first sensor is supported through the support part.

13. The cajon according to claim 12, further comprising an echo wire that has a base end attached to the support part such that a front end of the echo wire is in contact with the struck surface plate.

14. The cajon according to claim 11, wherein the first sensor is located on a left side with respect to a lateral center of the struck surface plate in a front view and is located in a vertical center of the struck surface plate in a front view, and the second sensor is located in the lateral center of the struck surface plate in the front view.

15. The cajon according to claim 14, wherein a center of the sounding body is located on a right side with respect to the lateral center of the struck surface plate in the front view and is located on a side of the lower surface plate with respect to the first sensor.

16. The cajon according to claim 11, wherein a sound emission hole is formed to penetrate a left side or a right side of the struck surface plate with respect to a centerline that bisects the struck surface plate into left and right parts in a front view.

17. The cajon according to claim 11, wherein the case comprises the sound emission hole that penetrates the struck surface plate, and the sounding body is disposed inside the case at a predetermined distance from the sound emission hole.

18. The cajon according to claim 17, wherein the predetermined distance from the sounding body to the sound emission hole is set to be ⅙ or more and less than ½ of a distance from the struck surface plate to a rear surface plate, which is a part of the side surface plate and is opposite to the struck surface plate.

19. The cajon according to claim 17, wherein a diameter of the sound emission hole is set to be 1.0-1.5 times a distance between the sound emission hole and the sounding body.

20. The cajon according to claim 11, wherein the case comprises an opening that penetrates the struck surface plate, and a part of the sounding body is disposed inside the case while another part of the sounding body protrudes outside the case through the opening of the struck surface plate.

* * * * *